US012429263B2

(12) United States Patent
Ji et al.

(10) Patent No.: US 12,429,263 B2
(45) Date of Patent: Sep. 30, 2025

(54) OIL SEPARATION DEVICE, CONDENSER, AND REFRIGERATION SYSTEM USING OIL SEPARATION DEVICE OR CONDENSER

(71) Applicants: York (Wuxi) Air Conditioning and Refrigeration Co., Ltd., Wuxi (CN); Johnson Controls Tyco IP Holdings LLP, Milwaukee, WI (US)

(72) Inventors: Shicai Ji, Wuxi (CN); Xiuping Su, Wuxi (CN); Shengmei Yang, Wuxi (CN); Ronghua Yang, Wuxi (CN); Jing Chen, Wuxi (CN)

(73) Assignees: York (Wuxi) Air Conditioning and Refrigeration Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 205 days.

(21) Appl. No.: 17/764,945

(22) PCT Filed: Sep. 29, 2020

(86) PCT No.: PCT/CN2020/118776

§ 371 (c)(1),
(2) Date: Mar. 29, 2022

(87) PCT Pub. No.: WO2021/063348

PCT Pub. Date: Apr. 8, 2021

(65) Prior Publication Data

US 2022/0349634 A1 Nov. 3, 2022

(30) Foreign Application Priority Data

Sep. 30, 2019 (CN) ..... 201910943236.1

(51) Int. Cl.
*F25B 43/02* (2006.01)
*F25B 39/04* (2006.01)

(52) U.S. Cl.
CPC ..... *F25B 43/02* (2013.01); *F25B 39/04* (2013.01)

(58) Field of Classification Search
CPC .... F25B 43/20; F25B 2339/047; F25B 43/02; F28D 7/16; F28D 3/02; F28D 2021/0084; F28D 2021/007
See application file for complete search history.

(56) References Cited

U.S. PATENT DOCUMENTS 4,359,329 A * 11/1982 Willeitner ..... B01D 50/20 210/DIG. 5
5,875,637 A * 3/1999 Paetow ..... F25B 1/053 62/175

(Continued)

FOREIGN PATENT DOCUMENTS

CN 1170860 A 1/1998
CN 102967095 A 3/2013

(Continued)

OTHER PUBLICATIONS

CN-207379116-U Translation (Year: 2018).*

(Continued)

*Primary Examiner* — David J Teitelbaum
(74) *Attorney, Agent, or Firm* — Fletcher Yoder, P.C.

(57) ABSTRACT

Disclosed are an oil separation device (1283) and a condenser (130-1130) with an oil separation function, and a refrigeration system (100, 1200) using same. The oil separation device (1283) or the condenser (130-1130) comprises: a shell (201, 1301) comprising an oil separation cavity (315, 1315), a first refrigerant inlet (221, 1221), a second refrigerant inlet (222, 1222), a first flow guide channel (445-2145), and a second flow guide channel (446-2146), wherein refrigerant gas flowing through the two flow guide channels can be mixed. When the refrigeration system (100, 1200) comprises two compressors (108, 1208, 109, 1209) with (Continued)

different displacements, the requirement of filtering and separating a gaseous refrigerant and lubricating oil can be met without the need for designing the size of the oil separation cavity (315, 1315) in accordance with large-displacement compressors (109, 1209), and the size is small.

19 Claims, 14 Drawing Sheets

(56) References Cited

U.S. PATENT DOCUMENTS

| | | | | |
|---|---|---|---|---|
| 5,919,284 | A * | 7/1999 | Perry, Jr. | B01D 45/02 55/482 |
| 2013/0255308 | A1 * | 10/2013 | De Larminat | F25B 43/02 62/470 |
| 2014/0326008 | A1 | 11/2014 | Yoon et al. | |

FOREIGN PATENT DOCUMENTS

| | | | | |
|---|---|---|---|---|
| CN | 204006843 | U | | 12/2014 |
| CN | 105571219 | A | | 5/2016 |
| CN | 107367092 | A | | 11/2017 |
| CN | 207379116 | U | * | 5/2018 |
| CN | 211345950 | U | | 8/2020 |
| EP | 3650794 | A1 | | 5/2020 |
| JP | S56168776 | U | | 12/1981 |
| JP | H05118675 | A | | 5/1993 |
| KR | 20130043977 | A | | 5/2013 |
| WO | 2018035268 | A1 | | 2/2018 |

OTHER PUBLICATIONS

Extended European Search Report for EP Application No. 20870899.0, dated Oct. 20, 2023, 8 pages.

PCT International Search Report for PCT Application No. PCT/CN2020/118776, mailed Dec. 31, 2020, 5 pgs.

Japanese Office Action for JP Application No. 2022-519711, mailed May 29, 2024, 6 pages.

Chinese Office Action for CN Application No. 201910943236.1, dated Dec. 9, 2024, 8 pages.

* cited by examiner

A-A

C-C

B-B

OIL SEPARATION DEVICE, CONDENSER, AND REFRIGERATION SYSTEM USING OIL SEPARATION DEVICE OR CONDENSER

CROSS-REFERENCE TO RELATED APPLICATIONS

This application is a U.S. National Stage Application of PCT Application No. PCT/CN2020/118776, entitled "OIL SEPARATION DEVICE, CONDENSER, AND REFRIGERATION SYSTEM USING OIL SEPARATION DEVICE OR CONDENSER," filed Sep. 29, 2020, which claims priority to and the benefit of Chinese Patent Application No. 201910943236.1, filed Sep. 30, 2019, each of which is herein incorporated by reference in its entirety for all purposes.

BACKGROUND

Technical Field

This application relates to an oil separation device, a condenser, and a refrigeration system using the oil separation device or the condenser, and more particularly to a refrigeration system including two compressors.

Related Art

In existing refrigeration systems, a lubricating substance (e.g. lubricating oil) for lubricating a compressor is discharged from a compressor along with a gaseous refrigerant compressed by the compressor. The gaseous refrigerant and the lubricating oil generally complete oil-gas separation through an oil separation device or a condenser with an oil separation function, the separated lubricating oil is returned to the compressor, and the separated gaseous refrigerant is subsequently condensed into a liquid refrigerant. Specifically, the oil separation device or the condenser with an oil separation function each includes an oil separation cavity in which a filter screen is disposed. In the oil separation cavity, the gaseous refrigerant and the lubricating oil pass through the filter screen and the lubricating oil is separated from the gaseous refrigerant.

Generally, the size of the oil separation cavity affects the size of the oil separation device or the condenser with an oil separation function, and the size of the oil separation cavity is also related to the displacement of the compressor. As the displacement of the compressor is larger, a flow rate of a mixture of the lubricating oil and the gaseous refrigerant discharged per unit time into the oil separation cavity is larger, and the oil separation cavity needs to have a sufficiently large size in order to obtain a reasonable flow velocity and ensure a separation effect of the lubricating oil and the gaseous refrigerant.

SUMMARY

In a first aspect, this application provides an oil separation device. The oil separation device includes: a shell including an oil separation cavity therein; a first refrigerant inlet and a second refrigerant inlet disposed on the shell; a first flow guide channel disposed in the oil separation cavity, the first flow guide channel having an inlet and an outlet, the inlet of the first flow guide channel being in fluid communication with the first refrigerant inlet so as to guide at least a portion of refrigerant gas entering the first refrigerant inlet from the inlet of the first flow guide channel to the outlet of the first flow guide channel; and a second flow guide channel disposed in the oil separation cavity, the second flow guide channel having an inlet and an outlet, the inlet of the second flow guide channel being in fluid communication with the second refrigerant inlet so as to guide at least a portion of refrigerant gas entering the second refrigerant inlet from the inlet of the second flow guide channel to the outlet of the second flow guide channel. The first flow guide channel and the second flow guide channel are configured to enable the refrigerant gas flowing out of the outlet of the first flow guide channel to be mixed with the refrigerant gas flowing out of the outlet of the second flow guide channel.

According to the aforementioned first aspect, the outlet of the first flow guide channel and the outlet of the second flow guide channel are close to each other.

According to the aforementioned first aspect, the oil separation device further includes: at least one communication port for fluid communication with a condensation device; and at least one filter screen disposed in the oil separation cavity transverse to a length direction of the shell. The at least one filter screen is disposed among the at least one communication port, and the outlet of the first flow guide channel and the outlet of the second flow guide channel which are close to each other, so that the mixed refrigerant gas is capable of flowing through the at least one filter screen to the at least one communication port.

According to the aforementioned first aspect, the at least one communication port includes two communication ports which are respectively disposed at two opposite ends in the length direction of the shell. The at least one filter screen includes a first filter screen and a second filter screen. The first filter screen is disposed between the outlet of the first flow guide channel and one of the two communication ports. The second filter screen is disposed between the outlet of the second flow guide channel and the other of the two communication ports.

According to the aforementioned first aspect, the first flow guide channel and the second flow guide channel extend toward the middle of the shell along the length direction of the shell from two opposite ends in the length direction of the shell. The outlet of the first flow guide channel and the outlet of the second flow guide channel are configured to be spaced apart by a distance in the length direction of the shell or staggered by a distance in a direction perpendicular to the length direction of the shell.

According to the aforementioned first aspect, the outlet of the first flow guide channel is disposed between the outlet of the second flow guide channel and the inlet of the first flow guide channel, and the outlet of the second flow guide channel is disposed between the outlet of the first flow guide channel and the inlet of the second flow guide channel.

According to the aforementioned first aspect, the outlet of the first flow guide channel is disposed between the outlet of the second flow guide channel and the inlet of the second flow guide channel, and the outlet of the second flow guide channel is disposed between the outlet of the first flow guide channel and the inlet of the first flow guide channel.

According to the aforementioned first aspect, the oil separation device further includes: a blocking member disposed between the outlet of the first flow guide channel and the outlet of the second flow guide channel.

According to the aforementioned first aspect, the blocking member is a blocking plate or a filter screen.

According to the aforementioned first aspect, the position and size of the blocking member are configured such that the blocking member is capable of at least partially blocking the outlet of the first flow guide channel and the outlet of the second flow guide channel in the length direction of the shell.

According to the aforementioned first aspect, the first flow guide channel is formed by a first flow guide baffle and the shell, and the second flow guide channel is formed by a second flow guide baffle and the shell.

According to the aforementioned first aspect, the middle of the first flow guide baffle and/or the second flow guide baffle is bent to form an upper plate and a lower plate at a certain included angle.

According to the aforementioned first aspect, the first flow guide channel is formed by a first flow guide tube, and the second flow guide channel is formed by a second flow guide tube.

According to the aforementioned first aspect, the second flow guide channel has an additional outlet disposed away from the outlet of the first flow guide channel. The at least one communication port includes a communication port located between the outlet of the second flow guide channel and the additional outlet. The at least one filter screen includes a filter screen disposed between the outlet of the second flow guide channel and the communication port. The oil separation device further includes an additional filter screen disposed between the additional outlet of the second flow guide channel and the communication port.

According to the aforementioned first aspect, the first flow guide channel extends longitudinally from one end in the length direction of the shell into the oil separation cavity of the shell, and the second flow guide channel extends from the other end in the length direction of the shell toward the first flow guide channel.

According to the aforementioned first aspect, the first flow guide channel is formed by a straight flow guide tube, and the second flow guide channel is formed by a flow guide baffle and the shell.

According to the aforementioned first aspect, the first flow guide channel and the second flow guide channel extend longitudinally side by side from the middle of the shell into the oil separation cavity of the shell, and the first flow guide channel and the second flow guide channel are both formed by a straight flow guide tube. The first flow guide channel is disposed near the second flow guide channel.

According to the aforementioned first aspect, the at least one communication port is disposed on the shell for fluid communication with the condensation device in a condenser.

At least one object of this application in a first aspect is to provide a condenser. The condenser includes: a shell having an accommodating cavity therein; an oil separation baffle disposed in the shell and extending along a length direction of the shell, the oil separation baffle partitioning the accommodating cavity into an oil separation cavity and a condensation cavity, the oil separation baffle including at least one communication port communicating the oil separation cavity and the condensation cavity; a first refrigerant inlet and a second refrigerant inlet disposed on the shell; a first flow guide channel disposed in the oil separation cavity, the first flow guide channel having an inlet and an outlet, the inlet of the first flow guide channel being in fluid communication with the first refrigerant inlet so as to guide at least a portion of refrigerant gas entering the first refrigerant inlet from the inlet of the first flow guide channel to the outlet of the first flow guide channel; and a second flow guide channel disposed in the oil separation cavity, the second flow guide channel having an inlet and an outlet, the inlet of the second flow guide channel being in fluid communication with the second refrigerant inlet so as to guide at least a portion of refrigerant gas entering the second refrigerant inlet from the inlet of the second flow guide channel to the outlet of the second flow guide channel. The first flow guide channel and the second flow guide channel are configured to enable the refrigerant gas flowing out of the outlet of the first flow guide channel to be mixed with the refrigerant gas flowing out of the outlet of the second flow guide channel.

According to the aforementioned second aspect, the outlet of the first flow guide channel and the outlet of the second flow guide channel are close to each other.

According to the aforementioned second aspect, the condenser further includes: at least one communication port for fluid communication with a condensation device; and at least one filter screen disposed in the oil separation cavity perpendicular to a length direction of the shell. The at least one filter screen is disposed among the at least one communication port, and the outlet of the first flow guide channel and the outlet of the second flow guide channel which are close to each other, so that the mixed refrigerant gas is capable of flowing through the at least one filter screen to the at least one communication port.

According to the aforementioned second aspect, the at least one communication port includes two communication ports which are respectively disposed at two opposite ends in the length direction of the shell. The at least one filter screen includes a first filter screen and a second filter screen. The first filter screen is disposed between the outlet of the first flow guide channel and one of the two communication ports. The second filter screen is disposed between the outlet of the second flow guide channel and the other of the two communication ports.

According to the aforementioned second aspect, the first flow guide channel and the second flow guide channel extend toward the middle of the shell along the length direction of the shell from two opposite ends in the length direction of the shell. The outlet of the first flow guide channel and the outlet of the second flow guide channel are configured to be spaced apart by a distance in the length direction of the shell or staggered by a distance in a direction perpendicular to the length direction of the shell.

According to the aforementioned second aspect, the outlet of the first flow guide channel is disposed between the outlet of the second flow guide channel and the inlet of the first flow guide channel, and the outlet of the second flow guide channel is disposed between the outlet of the first flow guide channel and the inlet of the second flow guide channel.

According to the aforementioned second aspect, the outlet of the first flow guide channel is disposed between the outlet of the second flow guide channel and the inlet of the second flow guide channel, and the outlet of the second flow guide channel is disposed between the outlet of the first flow guide channel and the inlet of the first flow guide channel.

According to the aforementioned second aspect, the condenser further includes: a blocking member disposed between the outlet of the first flow guide channel and the outlet of the second flow guide channel.

According to the aforementioned second aspect, the blocking member is a blocking plate or a filter screen.

According to the aforementioned second aspect, the position and size of the blocking member are configured such that the blocking member is capable of at least partially blocking the outlet of the first flow guide channel and the outlet of the second flow guide channel in the length direction of the shell.

According to the aforementioned second aspect, the first flow guide channel is formed by a first flow guide baffle and the shell, and the second flow guide channel is formed by a second flow guide baffle and the shell.

According to the aforementioned second aspect, the first flow guide channel is formed by a first flow guide tube, and the second flow guide channel is formed by a second flow guide tube.

According to the aforementioned second aspect, the second flow guide channel has an additional outlet disposed away from the outlet of the first flow guide channel. The at least one communication port includes a communication port located between the outlet of the second flow guide channel and the additional outlet. The at least one filter screen includes a filter screen disposed between the outlet of the second flow guide channel and the communication port. The condenser further includes an additional filter screen disposed between the additional outlet of the second flow guide channel and the communication port.

According to the aforementioned second aspect, the first flow guide channel extends longitudinally from one end in the length direction of the shell into the oil separation cavity of the shell, and the second flow guide channel extends from the other end in the length direction of the shell toward the first flow guide channel.

According to the aforementioned second aspect, the first flow guide channel is formed by a straight flow guide tube, and the second flow guide channel is formed by a flow guide baffle and the shell.

According to the aforementioned second aspect, the first flow guide channel and the second flow guide channel extend longitudinally side by side from the middle of the shell into the oil separation cavity of the shell, and the first flow guide channel and the second flow guide channel are both formed by a straight flow guide tube. The first flow guide channel is disposed near the second flow guide channel.

At least one object of this application in a third aspect is to provide a refrigeration system. The refrigeration system includes: a compressor unit; an oil separation device, which is an oil separation device according to the aforementioned first aspect; a condenser; a throttle device; and an evaporator. The compressor unit, the oil separation device, the condenser, the throttle device, and the evaporator are sequentially connected to form a refrigerant circulation loop. The compressor unit includes: a first compressor and a second compressor connected in parallel between the oil separation device and the evaporator. A suction port of the first compressor and a suction port of the second compressor are connected to the evaporator. An exhaust port of the first compressor is connected to the first refrigerant inlet of the oil separation device, and an exhaust port of the second compressor is connected to the second refrigerant inlet of the oil separation device.

According to the aforementioned third aspect, the displacement of the first compressor is smaller than the displacement of the second compressor.

At least one object of this application in a fourth aspect is to provide a refrigeration system. The refrigeration system includes: a compressor unit; a condenser, which is a condenser according to the aforementioned second aspect; a condenser; a throttle device; and an evaporator. The compressor unit, the condenser, the throttle device, and the evaporator are sequentially connected to form a refrigerant circulation loop. The compressor unit includes: a first compressor and a second compressor connected in parallel between the condenser and the evaporator. A suction port of the first compressor and a suction port of the second compressor are connected to the evaporator. An exhaust port of the first compressor is connected to the first refrigerant inlet of the condenser, and an exhaust port of the second compressor is connected to the second refrigerant inlet of the condenser.

According to the aforementioned fourth aspect, the displacement of the first compressor is smaller than the displacement of the second compressor.

DETAILED DESCRIPTION

Various implementations of this application are described below with reference to the accompanying drawings which form a part of this specification. It should be understood that although directional terms such as “front”, “rear”, “upper”, "lower", "left", "right", "top", or "bottom" are used in this application to describe various exemplary structural parts and elements of this application. However, these terms used herein are merely for convenience of description, which are determined based on an exemplary orientation in the accompanying drawings. The embodiments disclosed in this application may be arranged in different directions. Therefore, these directional terms are merely used for description and should not be construed as a limit.

Figure 1:
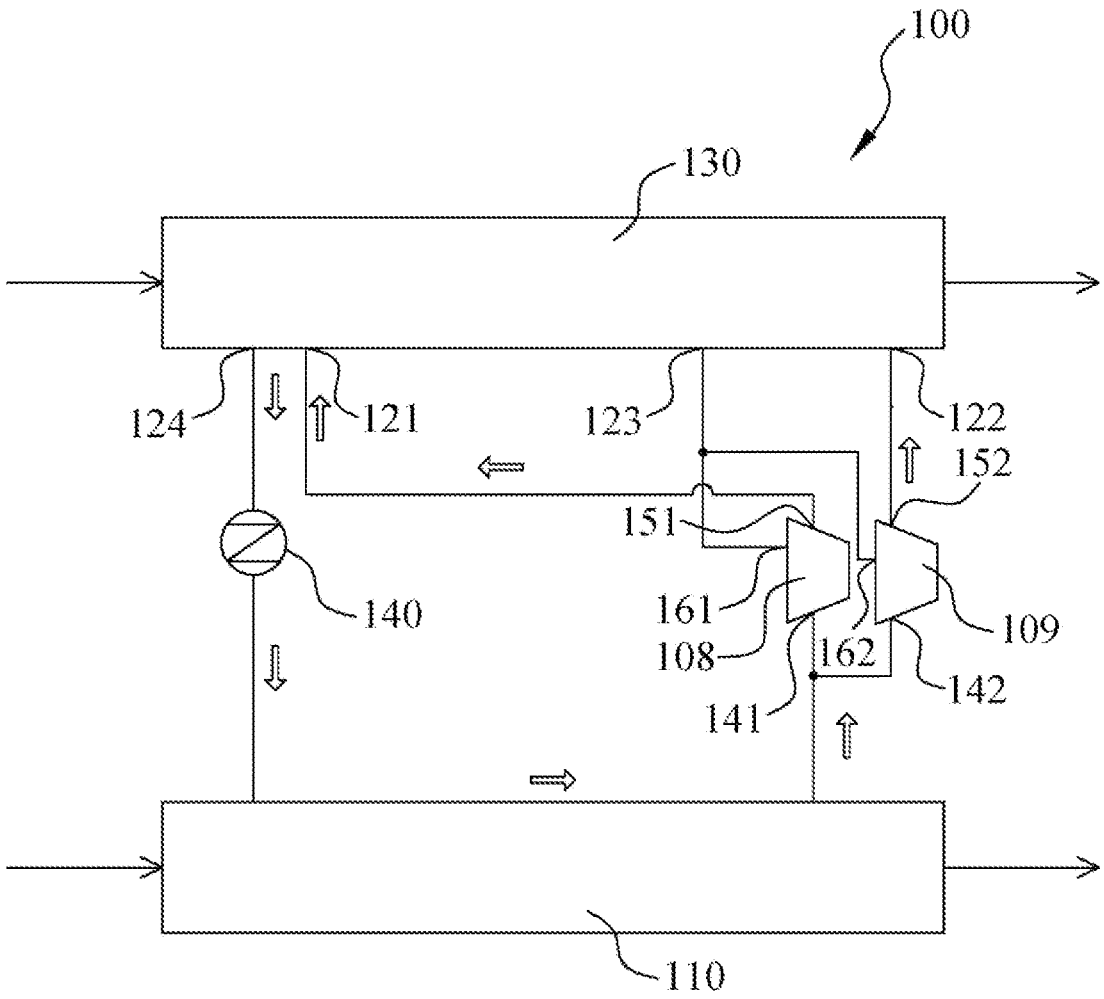
FIG. 1 is a structural block diagram of one embodiment for a refrigeration system of this application.

FIG. 1 is a structural block diagram of one embodiment for a refrigeration system 100 of this application to illustrate a connection relationship between components in a refrigeration system including two compressors in parallel. In an embodiment of this application, a condenser 130 has an oil separation function, and a specific structure for achieving the function will be described in detail below.

As shown in FIG. 1, a refrigeration system 100 includes a compressor unit, a condenser 130, a throttle device 140, and an evaporator 110 sequentially connected in through a pipeline to form a refrigerant circulation circuit. The compressor unit includes a first compressor 108 and a second compressor 109. The displacement of the first compressor 108 (i.e. refrigerant gas flow) is smaller than the displacement of the second compressor 109. The first compressor 108 and the second compressor 109 are connected in parallel between the condenser 130 and the evaporator 110.

Specifically, the first compressor 108 is provided with a suction port 141, an exhaust port 151 and an oil return port 161. The second compressor 109 is provided with a suction port 142, an exhaust port 152 and an oil return port 162. The condenser 130 is provided with a first refrigerant inlet 121, a second refrigerant inlet 122, a refrigerant outlet 124, and an oil outlet 123. The suction port 141 of the first compressor 108 and the suction port 142 of the second compressor 109 are both connected to an outlet of the evaporator 110. The exhaust port 151 of the first compressor 108 is connected to the first refrigerant inlet 121 of the condenser 130. The oil return port 161 of the first compressor 108 is connected to the oil outlet 123 of the condenser 130. The exhaust port 152 of the second compressor 109 is connected to the second refrigerant inlet 122 of the condenser 130. The oil return port 162 of the second compressor 109 is also connected to the oil outlet 123 of the condenser 130. The refrigerant outlet 124 of the condenser 130 is connected to the throttle device 140.

The refrigeration system 100 is filled with a refrigerant and a lubricating substance (e.g. lubricating oil). An operation process of the refrigeration system 100 is briefly described below:

In the first compressor 108 and the second compressor 109, a low-temperature low-pressure gaseous refrigerant is compressed into a high-temperature high-pressure gaseous refrigerant. The high-temperature high-pressure gaseous refrigerant flows into the condenser 130 through the first refrigerant inlet 121 and the second refrigerant inlet 122 on the condenser 130, respectively. In the condenser 130, the high-temperature high-pressure gaseous refrigerant first passes through an oil separation cavity 315 (not shown in FIGS. 1 and 2, see FIG. 3) and is then condensed exothermically into a high-pressure liquid refrigerant (possibly containing a portion of the gaseous refrigerant) in a condensation cavity 316 (not shown in FIGS. 1 and 2, see FIG. 3) in the condenser 130. The high-pressure liquid refrigerant is discharged from the refrigerant outlet 124 of the condenser 130, and flows through and is throttled by the throttle device 140 into a low-pressure liquid refrigerant. Subsequently, the low-pressure liquid refrigerant is endothermically evaporated in the evaporator 110 into the low-temperature low-pressure gaseous refrigerant and then returned to the first compressor 108 and the second compressor 109. The operation is repeated to complete a continuous refrigeration cycle.

In the first compressor 108 and the second compressor 109, the lubricating oil is used for lubricating the first compressor 108 and the second compressor 109, and then the lubricating oil is discharged from the first compressor 108 and the second compressor 109 together with the gaseous refrigerant. The discharged mixture of high-pressure gaseous refrigerant and lubricating oil (hereinafter referred to as "mixture") enters the condenser 130. In the oil separation cavity 315 of the condenser 130, the high-pressure gaseous refrigerant is separated from the lubricating oil. The separated high-pressure gaseous refrigerant enters the condensation cavity 316 in the condenser 130 as described above, while the separated lubricating oil flows back to the first compressor 108 and the second compressor 109 through the oil outlet 123 of the condenser 130.

For ease of description, the condenser 130 in this application is described as a shell-and-tube type condenser. However, those skilled in the art will appreciate that the condenser 130 may not only be a shell-and-tube type condenser, but the condenser 130 may also be a different type of condenser in accordance with the spirit of this application. For example, the condenser 130 may also be a tube-in-tube condenser or the like.

Figure 2:
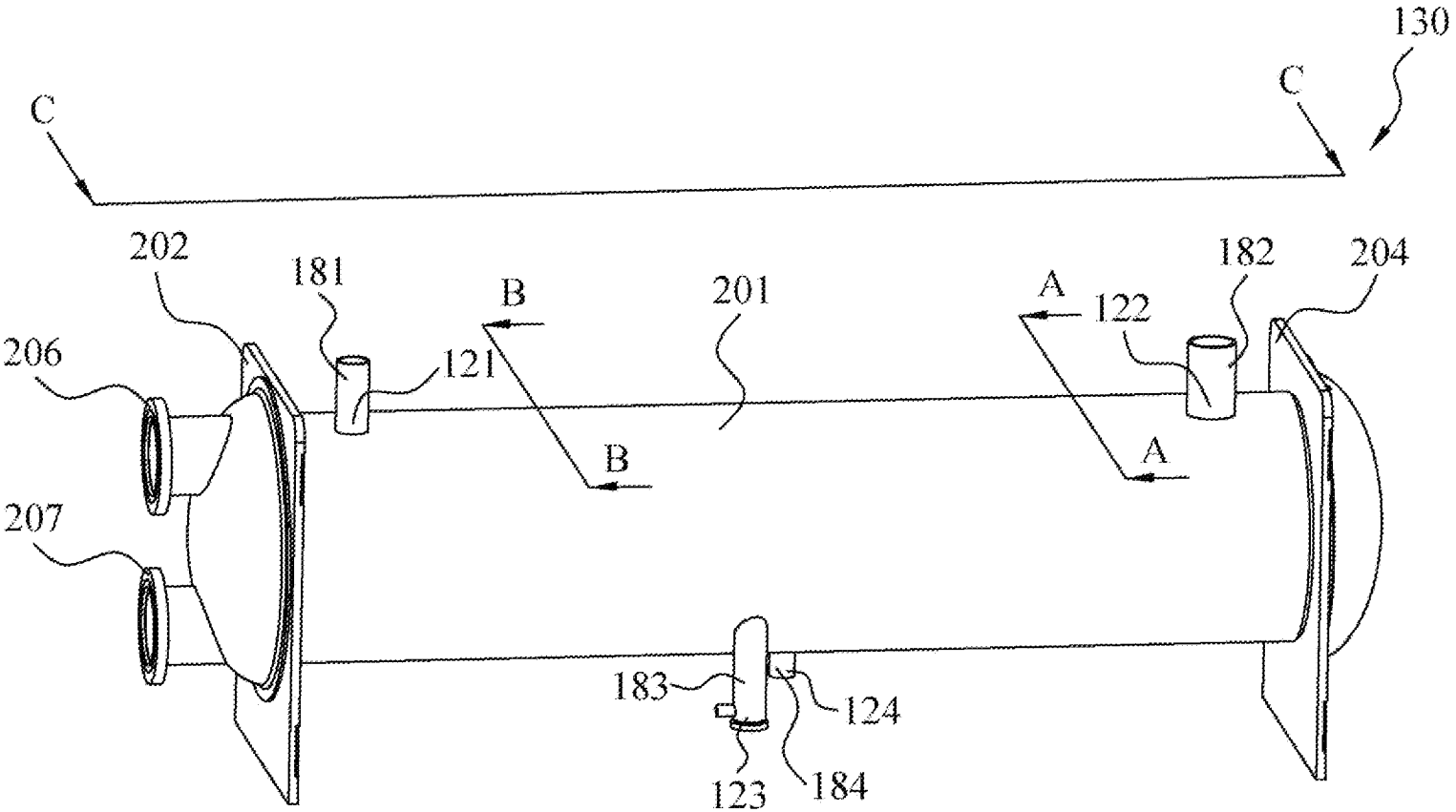
FIG. 2 is a structural stereogram of a condenser in FIG. 1.

FIG. 2 is a structural stereogram of some embodiments for the condenser 130 in FIG. 1 to illustrate an external structure of the condenser 130 in these embodiments. As shown in FIG. 2, the condenser 130 includes a shell 201. The shell 201 has a substantially cylindrical shape, and left and right ends thereof in a length direction are closed by an end plate 202 and an end plate 204. The shell 201 is provided with a first refrigerant inlet 121, a second refrigerant inlet 122, an oil outlet 123, and a refrigerant outlet 124. The first refrigerant inlet 121 and the second refrigerant inlet 122 are located at an upper portion of the shell 201 and are disposed near the left and right ends of the shell 201, respectively. The oil outlet 123 and the refrigerant outlet 124 are located in the middle of a lower portion of the shell 201. The condenser 130 further includes a water supply tube 206 and a water return tube 207. The water supply tube 206 and the water return tube 207 are disposed on the end plate 202 and can be in fluid communication with a condensation device 313 (see FIG. 3 for details) in the condenser 130 so that a cooling medium (e.g. water) can flow into and out of the condenser 130.

The condenser 130 further includes a pipeline 181, a pipeline 182, a pipeline 183, and a pipeline 184. The pipeline 181 is communicated with the first refrigerant inlet 121 such that the first refrigerant inlet 121 is connected to the exhaust port 151 of the first compressor 108. The pipeline 182 is communicated with the second refrigerant inlet 122 such that the second refrigerant inlet 122 is connected to the exhaust port 152 of the second compressor 109. Since the displacement of the first compressor 108 is smaller than the displacement of the second compressor 109, the size of the first refrigerant inlet 121 is smaller than the size of the second refrigerant inlet 122. Accordingly, the pipeline 181 has a smaller tube diameter than the pipeline 182. The pipeline 183 is communicated with the oil outlet 123 such that the oil outlet 123 is connected to the oil return port 161 and the oil return port 162. The pipeline 184 is communicated with the refrigerant outlet 124 such that the refrigerant outlet 124 is connected to the throttle device 140.

It is to be noted that the first refrigerant inlet 121, the second refrigerant inlet 122, the oil outlet 123, and the refrigerant outlet 124 of the condenser may be arranged at different positions according to specific settings of different condensers. For example, in an embodiment shown in FIG. 11, the first refrigerant inlet 121 and the second refrigerant inlet 122 are disposed in the middle of the shell 201.

Figure 3:
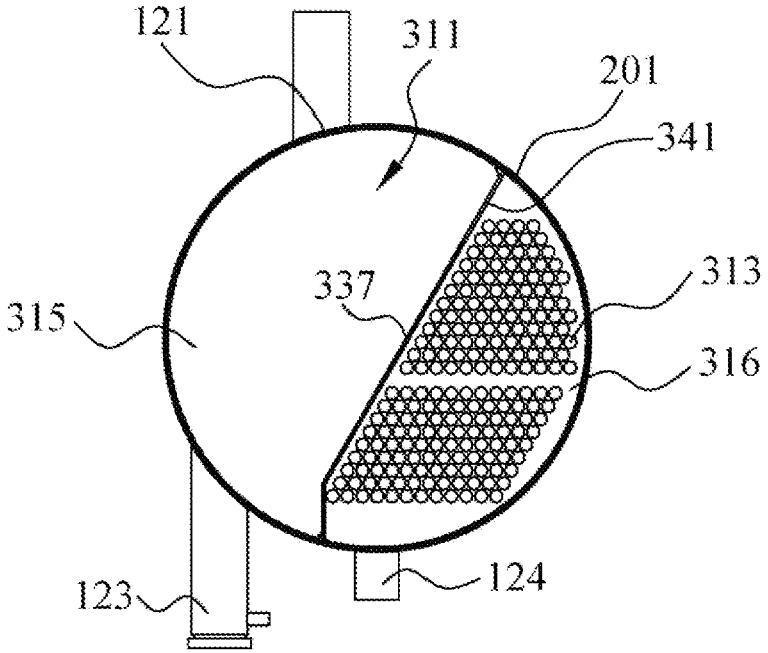
FIG. 3 is a diagram of a positional relationship between an oil separation cavity and a condensation cavity of the condenser in FIG. 1.

FIG. 3 is a diagram of a positional relationship between an oil separation cavity and a condensation cavity in some embodiments for the condenser 130, which is generally a cross-sectional view as taken along a line A-A in FIG. 2, where some components are omitted and only the oil separation cavity and the condensation cavity are shown. As shown in FIG. 3, the condenser 130 has an accommodating cavity 311 in the shell 201. The condenser 130 includes an oil separation baffle 337. The oil separation baffle 337 is obliquely disposed in the shell 201 and extends along the length direction of the shell 201 to be connected to an inner wall of the shell 201. The oil separation baffle 337 partitions the accommodating cavity 311 into an oil separation cavity 315 and a condensation cavity 316. Components (not shown) accommodated in the oil separation cavity 315 enable the lubricating oil to be separated from the gaseous refrigerant. The condensation device 313 accommodated in the condensation cavity 316 enables the gaseous refrigerant to be condensed into a liquid refrigerant. An upper portion of the oil separation baffle 337 is provided with at least one communication port 341, and the at least one communication port 341 is used for communicating the oil separation cavity 315 and the condensation cavity 316 so that the gaseous refrigerant separated from the lubricating oil flows from the oil separation cavity 315 into the condensation cavity 316.

Referring to FIG. 2, the first refrigerant inlet 121, the second refrigerant inlet 122 and the oil outlet 123 are in fluid communication with the oil separation cavity 315. The water supply tube 206, the water return tube 207 and the refrigerant outlet 124 are in fluid communication with the condensation cavity 316. The condensation device 313 is disposed in the condensation cavity 316. As one example, the condensation device 313 in this application is a heat exchange tube bundle. The heat exchange tube bundle extends along the length direction of the shell 201 and is in fluid communication with the water supply tube 206 and the water return tube 207.

Figure 4A:
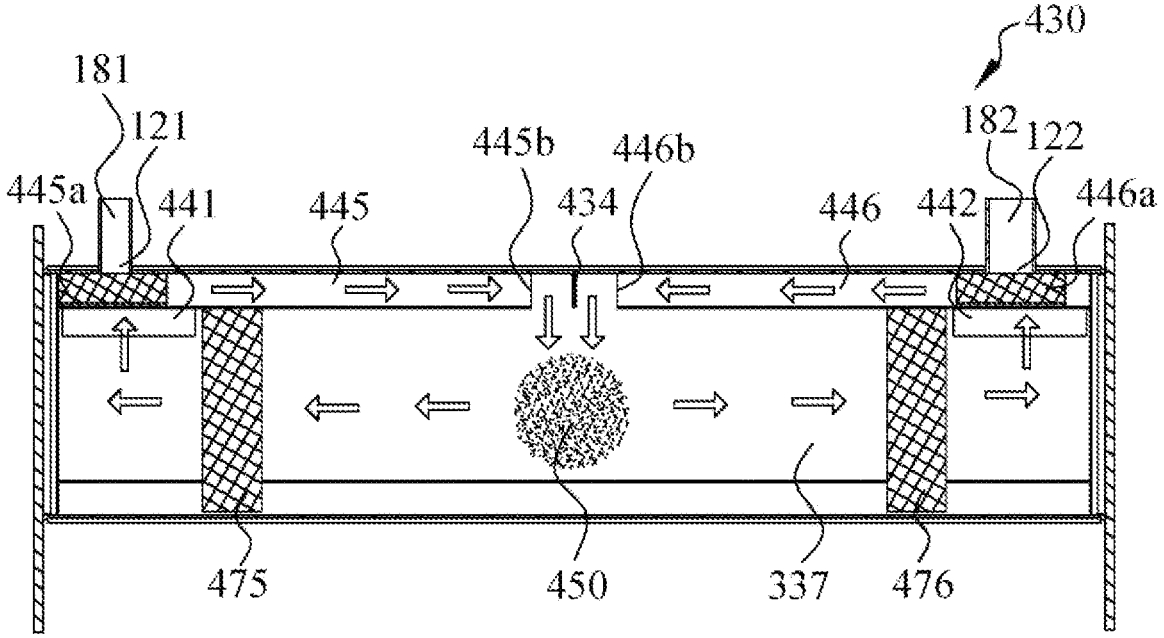
FIG. 4A is an axial cross-sectional view of a first embodiment for the condenser in FIG. 1.
Figure 4B:
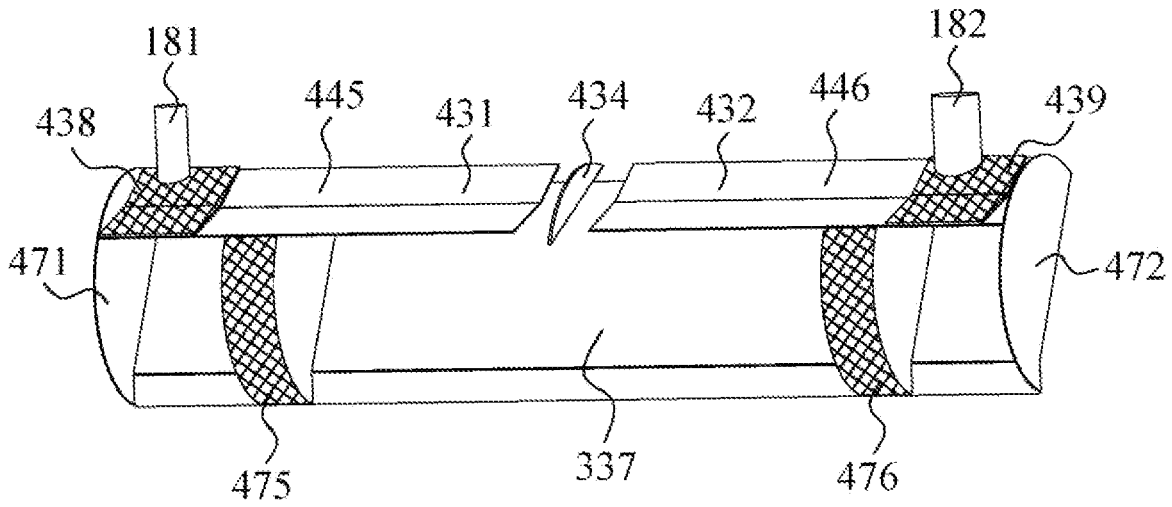
FIG. 4B is a structural stereogram of an internal structure of the condenser shown in FIG. 4A from the perspective of a front side.
Figure 4C:
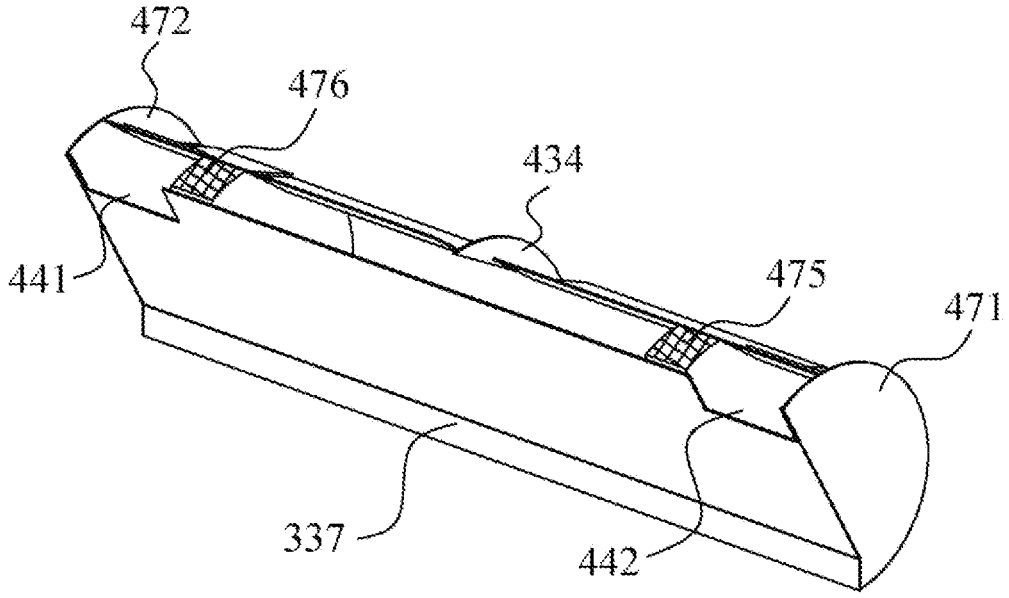
FIG. 4C is a structural stereogram of an internal structure of the condenser shown in FIG. 4A from the perspective of a rear side.
Figure 4D:
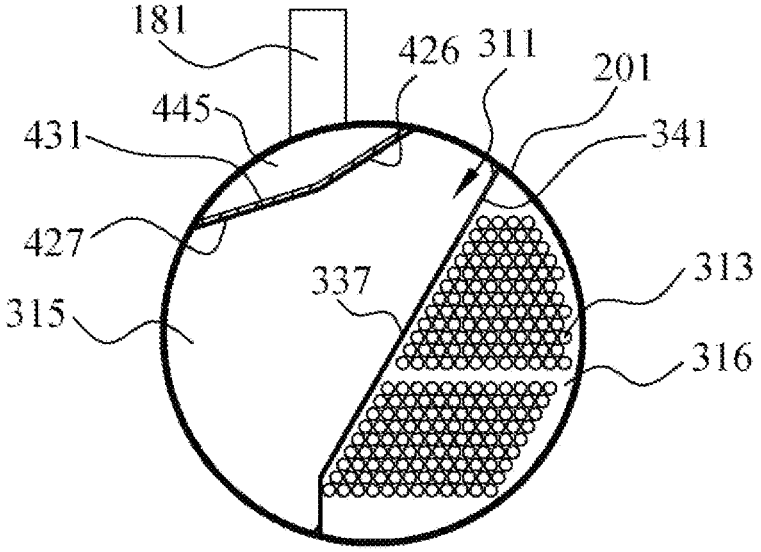
FIG. 4D is a radial cross-sectional view of the condenser in FIG. 4A.

FIGS. 4A-4D show a first embodiment for a condenser of this application, an external structure thereof is shown in FIG. 2, and a positional relationship between an oil separation cavity and a condensation cavity therein is shown in FIG. 3. FIG. 4A is a cross-sectional view along an axial direction (i.e. C-C line direction in FIG. 2) of a shell in a first embodiment for a condenser according to this application, so as to illustrate various components in the oil separation cavity 315, where the water supply tube 206 and the water return tube 207 are omitted. FIG. 4B is a structural stereogram of the oil separation baffle 337, the pipeline 181, the pipeline 182, and various components in the oil separation cavity 315 in a condenser 430 shown in FIG. 4A from the perspective of a front side. FIG. 4C is a structural stereogram of various components shown in FIG. 4B from the perspective of a rear side. FIG. 4D is a cross-sectional view along a radial direction (i.e. B-B line direction in FIG. 2) of a shell in the condenser 430 shown in FIG. 4A, where the end plate 202 is omitted.

As shown in FIGS. 4A-4D, the condenser 430 includes a left seal plate 471 and a right seal plate 472. The left seal plate 471 and the right seal plate 472 are symmetrically disposed at left and right ends of the oil separation cavity 315, and are in sealed connection with the shell 201 and the oil separation baffle 337.

The condenser 430 further includes a first flow guide baffle 431. A left end of the first flow guide baffle 431 is connected to the left seal plate 471, and the first flow guide baffle 431 extends from the left seal plate 471 to the middle of the shell 201 along the length direction (i.e. left-right direction) of the condenser 430. The first flow guide baffle 431 is obliquely disposed at an upper portion of the oil separation cavity 315 and connected to the inner wall of the shell 201. The middle of the first flow guide baffle 431 is bent toward the condensation cavity 316 in a radial section of the shell 201. A first flow guide channel 445 is formed among the first flow guide baffle 431, the left seal plate 471 and the shell 201. A radial section of the first flow guide channel 445 formed by the first flow guide baffle 431 and the shell 201 is generally arched. The first flow guide channel 445 has an inlet 445*a* and an outlet 445*b*. The inlet 445*a* is located at a left end of the first flow guide channel 445 and is in fluid communication with the first refrigerant inlet 121. The outlet 445*b* is located at a right end of the first flow guide channel 445. The accommodating cavity located below the first flow guide channel 445 in the oil separation cavity 315 is designed to be large enough to sufficiently separate the lubricating oil from the gaseous refrigerant.

As shown in FIG. 4D, in the radial section of the shell 201, the middle of the first flow guide baffle 431 is bent into the shell 201 to form an upper plate 426 and a lower plate 427 connected to each other, which form an included angle of a certain magnitude. In the case where the first flow guide baffle 431 and the shell 201 are connected to a certain position, the first flow guide baffle 431 is configured in a shape in which the middle is bent toward the condensation cavity 316, so that the radial cross-sectional area of the first flow guide channel 445 can be increased.

Similarly, the condenser 430 further includes a second flow guide baffle 432. A right end of the second flow guide baffle 432 is connected to the right seal plate 472, and the second flow guide baffle 432 extends from the right seal plate 472 to the middle of the shell 201 along the length direction (i.e. left-right direction) of the condenser 430. The second flow guide baffle 432 is obliquely disposed at an upper portion of the oil separation cavity 315 and connected to the inner wall of the shell 201. The middle of the second flow guide baffle 432 is also bent toward the condensation cavity 316 in the radial section of the shell 201, and the second flow guide baffle 432 has the same shape as the first flow guide baffle 431. A second flow guide channel 446 is formed among the second flow guide baffle 432, the right seal plate 472 and the shell 201. A radial section of the second flow guide channel 446 formed by the second flow guide baffle 432 and the shell 201 is generally arched. The second flow guide channel 446 has an inlet 446*a* and an outlet 446*b*. The inlet 446*a* is located at a right end of the second flow guide channel 446 and is in fluid communication with the second refrigerant inlet 122. The outlet 446*b* is located at a left end of the second flow guide channel 446. The accommodating cavity located below the second flow guide channel 446 in the oil separation cavity 315 is designed to be large enough to sufficiently separate the lubricating oil from the gaseous refrigerant.

As shown in FIGS. 4A-4C, the condenser 430 further includes a blocking member 434. The blocking member 434 is disposed between the outlet 445*b* of the first flow guide channel 445 and the outlet 446*b* of the second flow guide channel 446 for separating the outlet 445*b* from the outlet 446*b*. Specifically, the blocking member 434 is a blocking plate and is substantially fan-shaped, and a circular arc shape of the top of the blocking member matches a circular arc shape of the shell 201 so that the blocking member 434 can be connected to the shell 201. The radial sectional area of the blocking member 434 is set to be substantially the same as that of the outlet 445*b* and the outlet 446*b* so that the outlet 445*b* and the outlet 446*b* can be at least partially blocked in the length direction of the shell 201. This arrangement prevents the outlet 445*b* and the outlet 446*b* from being directly opposite, thereby preventing a mixture flowing out of one of the flow guide channels from penetrating into the other flow guide channel due to a high speed.

After the mixture flows into the condenser 430 through the first flow guide channel 445 and the second flow guide channel 446 respectively, the mixture flowing from the first flow guide channel 445 does not come into contact with the mixture flowing from the second flow guide channel 446 immediately, but changes a flow direction after being blocked by the blocking member 434, and mixes substantially at a mixing region 450 (shown as a dotted shadow in FIG. 4A).

It is to be noted that the outlet 445*b* of the first flow guide channel 445, the outlet 446*b* of the second flow guide channel 446, and the blocking member 434 are disposed together so that the mixtures flowing out of the outlet 445*b* and the outlet 446*b* can be mixed substantially in the vicinity of the mixing region 450.

The aforementioned mixing region 450 only schematically represents an approximate gas mixing part, and does not represent a physical division. In different embodiments, the position and size of the mixing region 450 may be different, but the mixing region 450, the outlet 445*b* of the first flow guide channel 445 and the outlet 446*b* of the second flow guide channel 446 should be close to each other according to the property that the mixture diffuses immediately after flowing out of the outlets.

It will be appreciated by those skilled in the art that the outlet of the first flow guide channel and the outlet of the second flow guide channel may not be entirely directly opposite, but may be configured to be rotationally staggered by a certain angle along a circumferential direction of the shell, or spaced apart in front-rear and up-down directions by a certain distance, and it is only necessary to ensure that the two outlets are close to each other so that refrigerants flowing out of the outlets can be mixed. In some embodiments, because the outlet of the first flow guide channel and the outlet of the second flow guide channel are not directly opposite, the blocking member 434 may be of any shape, or there may be no blocking member, as shown in embodiments in FIGS. 8-11.

As shown in FIGS. 4B-4C, the at least one communication port 341 includes a left communication port 441 and a right communication port 442, which are respectively disposed at upper portions of the left and right ends of the oil separation baffle 337 to communicate the oil separation cavity 315 and the condensation cavity 316 on both sides of the oil separation baffle 337. The left communication port 441 and the right communication port 442 are both square openings and have the same size.

The condenser 430 further includes a first filter screen 475 and a second filter screen 476, which are disposed in the oil separation cavity 315. Specifically, the first filter screen 475 is disposed below the first flow guide baffle 431, located between the left communication port 441 and the outlet 445*b*, and disposed near the left communication port 441. The second filter screen 476 is disposed below the second flow guide baffle 432, located between the right communication port 442 and the outlet 446*b*, and disposed near the right communication port 442. Both the first filter screen 475 and the second filter screen 476 extend in the oil separation cavity 315 along the radial direction of the condenser 430 (i.e. the filter screens need to be connected to the flow guide baffles, the oil separation baffle and the shell), so that the mixture passes through the first filter screen 475 or the second filter screen 476 before flowing from the outlet 445*b* or the outlet 446*b* to the left communication port 441 or the right communication port 442 to filter out lubricating oil therein. Thus, the lubricating oil in the mixture cannot be discharged from the left communication port 441 or the right communication port 442 to the condensation cavity 316.

The working principle of various components in the oil separation cavity 315 is described in detail below in conjunction with FIG. 4A. The arrows in FIG. 4A indicate a flow path of a mixture of gaseous refrigerant and lubricating oil in the oil separation cavity 315.

Specifically, a mixture (hereinafter referred to as "first mixture") of high-pressure gaseous refrigerant and lubricating oil discharged from the first compressor 108 enters the oil separation cavity 315 through the first refrigerant inlet 121. The first mixture flows in a substantially horizontal direction to the outlet 445*b* along the first flow guide channel 445 defined by the first flow guide baffle 431. A mixture (hereinafter referred to as "second mixture") of high-pressure gaseous refrigerant and lubricating oil discharged from the second compressor 109 enters the oil separation cavity 315 through the second refrigerant inlet 122. The second mixture flows in a substantially horizontal direction to the outlet 446*b* along the second flow guide channel 446 defined by the second flow guide baffle 432. After the first mixture and the second mixture hit against the blocking member 434 from a left side and a right side respectively, the flow direction is changed into downward flow. Without being blocked by the blocking member 434, the first mixture and the second mixture are mixed with each other substantially at the mixing region 450 while flowing downward.

In the condenser 430, on the one hand, the pressure in the condensation cavity 316 is lower than the pressure in the oil separation cavity 315, so that the mixture in the oil separation cavity 315 flows toward the condensation cavity 316. On the other hand, since both the left communication port 441 and the right communication port 442 are communicated with the condensation cavity 316, the pressures at the left communication port 441 and the right communication port 442 are substantially the same, and the sizes of the left communication port 441 and the right communication port 442 are also substantially the same. Therefore, when the first mixture and the second mixture are mixed with each other substantially at the mixing region 450, the two mixtures, which are divided into substantially the same flows under pressure, flow toward the left communication port 441 and the right communication port 442, respectively.

Since the components in the condenser 430 are arranged in a generally left-right symmetrical manner, the flow directions of the two mixtures are also similar. In order to make the description concise, this application takes a mixture flowing leftward after being mixed as an example to illustrate the flow of the mixture. Specifically, the mixture flows leftward and through the first filter screen 475. The first filter screen 475 has fine pores, and the lubricating oil in the mixture will be attached to the first filter screen 475, thereby separating the lubricating oil from the gaseous refrigerant. On the one hand, since the pressure in the condensation cavity 316 is lower than the pressure in the oil separation cavity 315, the gaseous refrigerant continues to flow to the left communication port 441. On the other hand, the lubricating oil attached to the first filter screen 475 is deposited at the bottom of the oil separation cavity 315 by gravity, and is discharged out of the oil separation cavity 315 through the oil outlet 123 at the bottom of the oil separation cavity 315.

It is to be noted that in order to prevent the mixture from directly impacting the first flow guide baffle 431 and the second flow guide baffle 432 when the mixture enters the oil separation cavity 315 at an excessive flow velocity, an impact prevention member 438 and an impact prevention member 439 may be disposed on the first flow guide baffle 431 and the second flow guide baffle 432, respectively. Specifically, the impact prevention member 438 and the impact prevention member 439 may be disposed at respective positions of the first flow guide baffle 431 and the second flow guide baffle 432 directly opposite to the first refrigerant inlet 121 and the second refrigerant inlet 122, respectively. As one example, the impact prevention member may be a filter screen.

It is also to be noted that a baffle (not shown) may also be disposed in the oil separation cavity 315 in order to prevent excessive flow of the mixture in the oil separation cavity 315 from disturbing the liquid level of the lubricating oil deposited in the oil separation cavity 315. The baffle is connected to the oil separation baffle 337 and the shell 201 between the first filter screen 475 and the second filter screen 476, and is configured to be disposed substantially horizontally above the liquid level of the lubricating oil so that the lubricating oil may flow down along the filter screen and be deposited at the bottom of the oil separation cavity 315 while the flow of the mixture does not impact the liquid level of the lubricating oil.

In the conventional condenser with an oil separation function, for a refrigeration system including a plurality of compressors, when various compressors are used in parallel in the same refrigeration system and an oil separation device or a condenser with an oil separation function is used in common, air usually enters from both ends in a length direction (or axial direction) of the oil separation device or the condenser, and flows, after being filtered by a filter screen respectively, to and is discharged through an exhaust port located in the middle in the length direction (or axial direction) of the oil separation device or the condenser. According to the aforementioned arrangement, when the displacement of the various compressors is different, the size (or radial cross-sectional area) of the oil separation cavity needs to be designed according to the compressor with the maximum displacement. However, for small-displacement compressors in the refrigeration system, the large-sized oil separation cavities are not required, and the corresponding oil cross-sectional area is passively enlarged and over-designed, thereby causing waste.

In this application, when the displacement of the first compressor 108 is smaller than the displacement of the second compressor 109, the condenser 430 enables a mixture of gaseous refrigerant and lubricating oil discharged from the first compressor 108 and the second compressor 109 to be mixed in the oil separation cavity 315 and then divided into two uniform parts for filtration. Therefore, the requirement of fully filtering and separating a gaseous refrigerant and lubricating oil can be met without the need for designing the size of the oil separation cavity 315 of the condenser 430 in accordance with the displacement of a large-displacement compressor (i.e. second compressor 109). The size of the oil separation cavity 315 can be small, so that the overall size of the condenser 430 is small.

As one example, the size of the oil separation cavity 315 may be designed according to the average displacement of a large-displacement compressor (i.e. second compressor 109) and a small-displacement compressor (i.e. first compressor 108).

Figure 5:
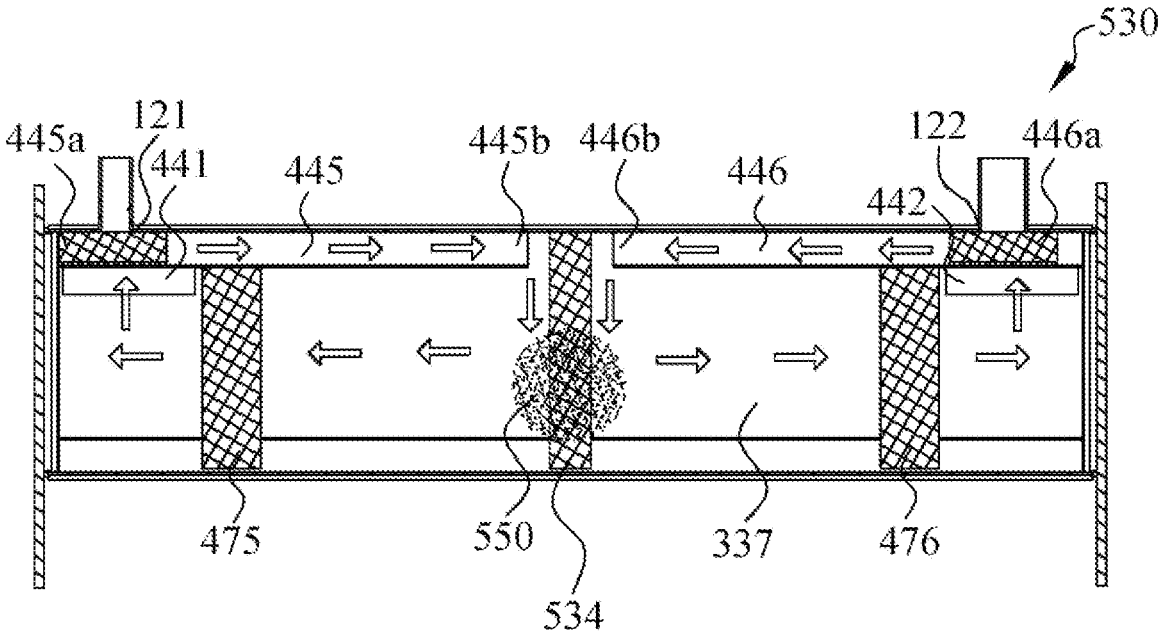
FIG. 5 is an axial cross-sectional view of a second embodiment for the condenser in FIG. 1.

FIG. 5 is a cross-sectional view of a second embodiment for a condenser according to this application in an axial direction of a shell (i.e. in C-C line direction in FIG. 2) to illustrate various components in the oil separation cavity 315. An external structure of the condenser according to the second embodiment is shown in FIG. 2, and a positional relationship between an oil separation cavity and a condensation cavity therein is shown in FIG. 3. The arrows in FIG. 5 indicate a flow path of a mixture of gaseous refrigerant and lubricating oil in the oil separation cavity 315.

Specifically, the structure of a condenser 530 is substantially the same as the structure of the condenser 430 shown in FIGS. 4A-4C, and the condenser 530 differs from the condenser 430 in that the blocking member is a filter screen 534 rather than a blocking plate in the embodiment shown in FIG. 5. The filter screen 534 has fine pores, but still prevents the second mixture discharged from the second compressor 109 from penetrating into the second flow guide channel 446. In addition, the first mixture and the second mixture can still be mixed in a mixing region 550 near the filter screen 534, and then uniformly divided into two parts, and the lubricating oil is separated by the first filter screen 475 and the second filter screen 476 respectively and then flows into the condensation cavity 316 for condensation. In this embodiment, the filter screen 534 also serves to adsorb and separate the lubricating oil in the mixture.

Figure 6:
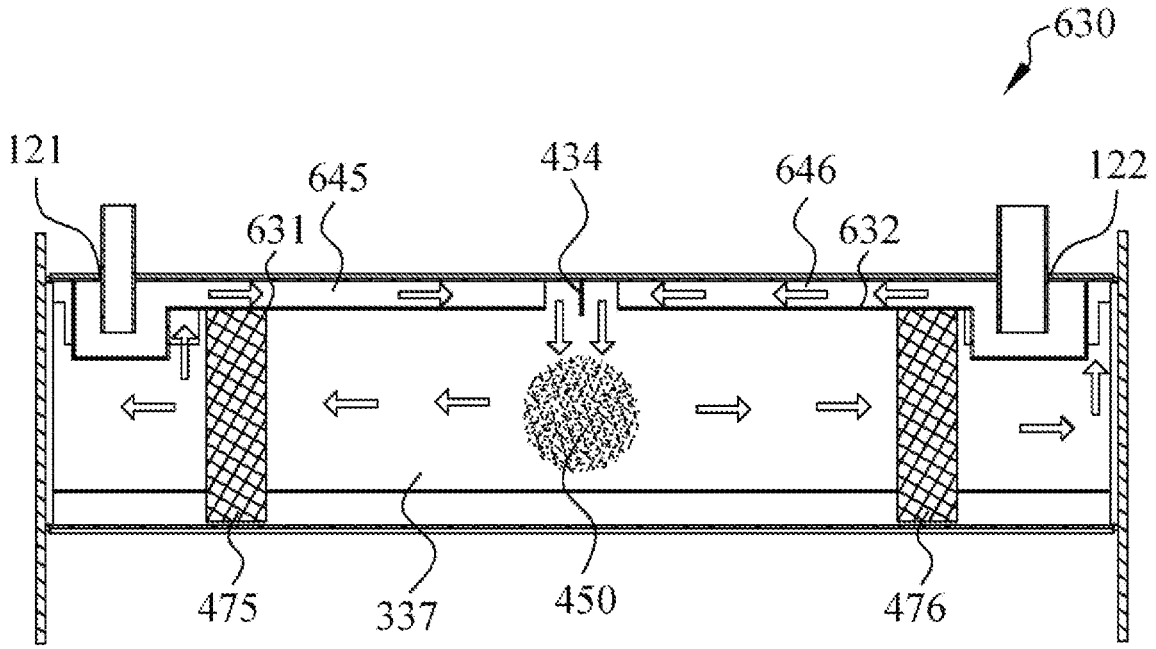
FIG. 6 is an axial cross-sectional view of a third embodiment for the condenser in FIG. 1.

FIG. 6 is a cross-sectional view of a third embodiment for a condenser of this application in an axial direction of a shell (i.e. in C-C line direction in FIG. 2) to illustrate various components in the oil separation cavity 315. An external structure of the condenser according to the third embodiment is shown in FIG. 2, and a positional relationship between an oil separation cavity and a condensation cavity therein is shown in FIG. 3. The arrows in FIG. 6 indicate a flow path of a mixture of gaseous refrigerant and lubricating oil in the oil separation cavity 315.

Specifically, the structure of a condenser 630 is substantially the same as the structure of the condenser 430 shown in FIGS. 4A-4C, and the condenser 630 differs from the condenser 430 in that specific structures of a first flow guide baffle 631 and a second flow guide baffle 632 at the inlet are different. As shown in FIG. 6, in the condenser 630, the first flow guide baffle 631 near the first refrigerant inlet 121 and the second flow guide baffle 632 near the second refrigerant inlet 122 are designed in the shape of a box with an open top. The first flow guide channel 645 is formed by the first flow guide baffle 631 and the shell 201, and the second flow guide channel 646 is formed by the second flow guide baffle 632 and the shell 201. In this way, the flow guide channels can be formed only by the flow guide baffles and the shell, and left and right seal plates are not required to define the first flow guide channel 645 and the second flow guide channel 646 respectively, so that the assembly steps of the condenser 630 can be simplified.

Specifically, the left end of the first flow guide baffle 631 is in the shape of a box with an open top. The right side of the box extends toward the middle of the shell 201 in the length direction of the shell 201 to form the first flow guide channel 645. The bottom of the first flow guide baffle 631 at the left end of the box extends downward to a position lower than the bottom of the first flow guide baffle 631 at other positions so that the flow guide channel radial area of the first flow guide channel at the box is larger than the flow guide channel radial area at other positions. The right end of the second flow guide baffle 632 is in the shape of a box with an open top. The left side of the box extends toward the middle of the shell 201 in the length direction of the shell 201 to form the second flow guide channel 646. The bottom of the second flow guide baffle 632 at the right end of the box extends downward to a position lower than the bottom of the second flow guide baffle 632 at other positions so that the flow guide channel radial area of the second flow guide channel at the box is larger than the flow guide channel radial area at other positions.

The left end of the first flow guide baffle 631 and the right end of the second flow guide baffle 632 are designed in the shape of a box with an open top to increase the flow guide channel radial area near the first refrigerant inlet 121 and the second refrigerant inlet 122, thereby reducing the speed of the mixture after entering the condenser 630 to reduce the impact of the mixture on the flow guide baffles. Thus, in this embodiment, the impact prevention member may not be provided.

Figure 7:
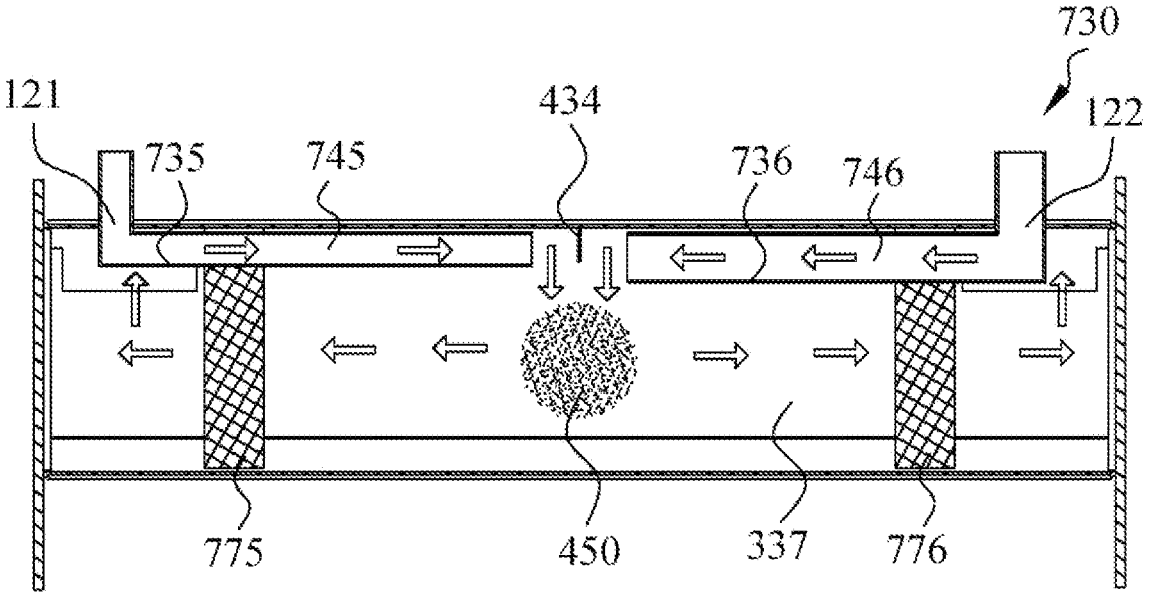
FIG. 7 is an axial cross-sectional view of a fourth embodiment for the condenser in FIG. 1.

FIG. 7 is a cross-sectional view of a fourth embodiment for a condenser of this application in an axial direction of a shell (i.e. C-C line direction in FIG. 2) to illustrate various components in the oil separation cavity 315. An external structure of the condenser according to the fourth embodiment is shown in FIG. 2, and a positional relationship between an oil separation cavity and a condensation cavity therein is shown in FIG. 3. The arrows in FIG. 7 indicate a flow path of a mixture of gaseous refrigerant and lubricating oil in the oil separation cavity 315.

Specifically, the structure of a condenser 730 is substantially the same as the structure of the condenser 430 shown in FIGS. 4A-4C, and the condenser 730 differs from the condenser 430 in that a first flow guide channel 745 and a second flow guide channel 746 are formed by pipelines respectively in the embodiment shown in FIG. 7. As shown in FIG. 7, the first flow guide channel 745 is formed by a first flow guide tube 735, and the second flow guide channel 746 is formed by a second flow guide tube 736. As one example, the first flow guide tube 735 extends out upward through the first refrigerant inlet 121 disposed on the shell 201 to be connected to the exhaust port 151 of the first compressor 108. The second flow guide tube 736 extends out upward through the second refrigerant inlet 122 disposed on the shell 201 to be connected to the exhaust port 152 of the second compressor 109.

In the present embodiment, the flow path of a mixture after entering flow guide channels is limited by directly forming the flow guide channels by flow guide tubes, without additionally providing the left seal plate 471 and/or the right seal plate 472 as shown in FIGS. 4A-4C.

It is to be noted that since the flow guide channels are formed by the flow guide tubes, a first filter screen 775 and a second filter screen 776 need to be connected to the flow guide tubes, the oil separation baffle and the shell so that the mixture flows into the condensation cavity 316 after passing through the first filter screen 775 or the second filter screen 776.

Figure 8:
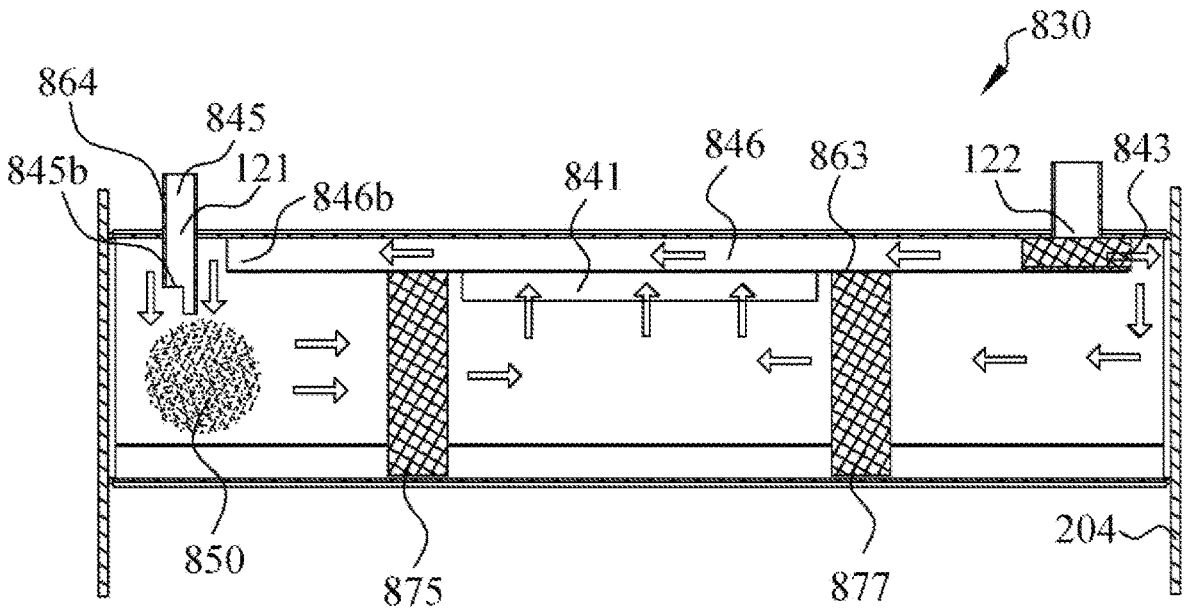
FIG. 8 is an axial cross-sectional view of a fifth embodiment for the condenser in FIG. 1.

FIG. 8 is a cross-sectional view of a fifth embodiment for a condenser of this application in an axial direction of a shell (i.e. C-C line direction in FIG. 2) to illustrate various components in the oil separation cavity 315. An external structure of the condenser according to the fifth embodiment is shown in FIG. 2, and a positional relationship between an oil separation cavity and a condensation cavity therein is shown in FIG. 3. The arrows in FIG. 8 indicate a flow path of a mixture of gaseous refrigerant and lubricating oil in the oil separation cavity 315. As shown in FIG. 8, a first flow guide channel 845 and a second flow guide channel 846 in a condenser 830 are formed by pipelines respectively.

Specifically, the first flow guide channel 845 is formed by a straight flow guide tube 864, which extends out upward through the first refrigerant inlet 121 disposed on the shell 201 to be connected to the exhaust port 151 of the first compressor 108. An outlet 845*b* of the first flow guide channel 845 is disposed at a lower end of the first flow guide channel 845.

The second flow guide channel 846 is formed by a flow guide baffle 863 and the shell 201. The flow guide baffle 863 is spaced from the top of the shell 201 by a certain distance and extends horizontally along the length direction of the shell 201. The second flow guide channel 846 is in fluid communication with the second refrigerant inlet 122. The second flow guide channel 846 has an outlet 846*b* at a left end thereof and an additional outlet 843 at a right end thereof. The outlet 846*b* is disposed near the outlet 845*b* of the first flow guide channel 845. The additional outlet 843 is disposed away from the outlet 845*b* of the first flow guide channel 845. After a mixture flows into the second flow guide channel 846 from the second refrigerant inlet 122, a part of the mixture flows out of the additional outlet 843, and another part of the mixture flows from right to left and out of the outlet 846*b*. The mixture flowing out of the outlet 845*b* of the first flow guide channel 845 is mixed with the mixture flowing out of the outlet 846*b* near a mixing region 850.

In the embodiment shown in FIG. 8, the condenser 830 includes only one communication port 841 disposed in the middle of the oil separation baffle 337. The condenser 830 further includes a first filter screen 875 and an additional filter screen 877. The first filter screen 875 is disposed between the outlet 846*b* of the second flow guide channel 846 and the communication port 841, and the additional filter screen 877 is disposed between the additional outlet 843 of the second flow guide channel 846 and the communication port 841.

The mixture mixed at the mixing region 850 flows through the first filter screen 875 from left to right. Upon passing through the first filter screen 875, a gaseous refrigerant is separated from lubricating oil. The gaseous refrigerant separated from the lubricating oil enters the condensation cavity from the communication port 841. The lubricating oil is deposited at the bottom of the oil separation cavity 315 by gravity. The mixture flowing out of the additional outlet 843 hits against the right end plate 204 on the right side of the shell 201 and then flows through the additional filter screen 877 from right to left. Upon passing through the additional filter screen 877, a gaseous refrigerant is separated from lubricating oil. The gaseous refrigerant separated from the lubricating oil enters the condensation cavity from the communication port 841. The lubricating oil is deposited at the bottom of the oil separation cavity 315 by gravity.

In the present embodiment, a mixture discharged from a large-displacement compressor (i.e. second compressor 109) is divided into two portions, one of which flows directly through the additional filter screen 877 and the other of which flows through the first filter screen 875 after being mixed with a gaseous refrigerant discharged from a small-displacement compressor (i.e. first compressor 108). By designing the size of the additional outlet 843, the flow of the mixture flowing through the additional filter screen 877 and the first filter screen 875 can be approximately equal, thereby also allowing the flow of the mixture to be automatically distributed into two uniform parts for filtration. The size of the oil separation cavity 315 can also be small, so that the overall size of the condenser 430 is small.

It is to be noted that in the present embodiment, since the outlets of the first flow guide channel 845 and the second flow guide channel 846 are not directly opposite, it is possible to prevent the mixture flowing out of one of the flow guide channels from penetrating into the other flow guide channel due to a high speed without providing the blocking member.

Figure 9:
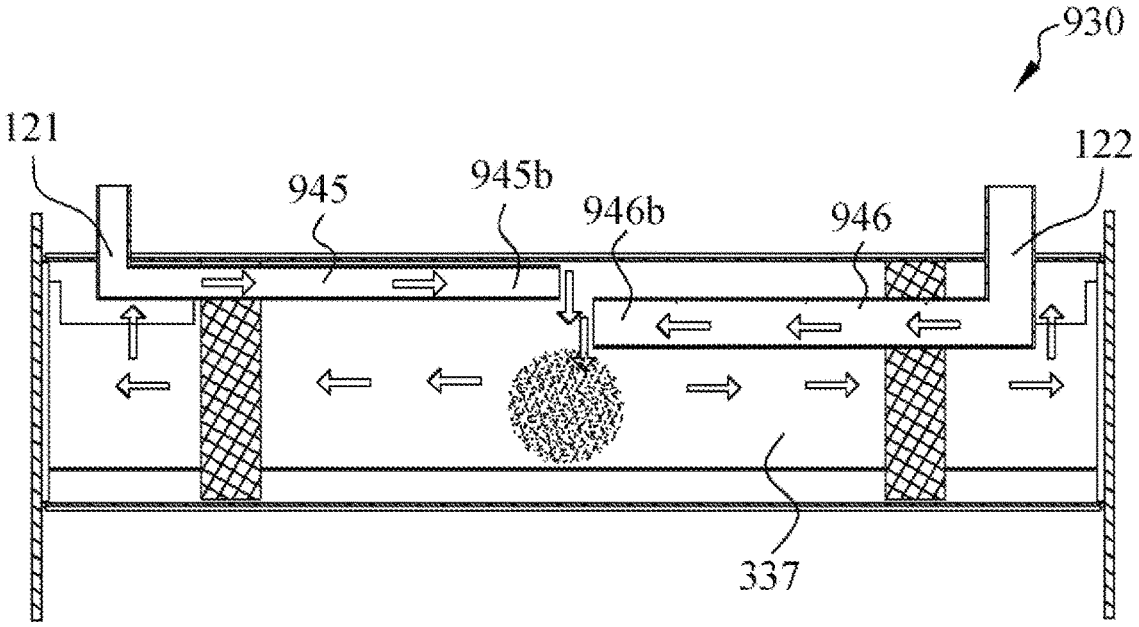
FIG. 9 is an axial cross-sectional view of a sixth embodiment for the condenser in FIG. 1.

FIG. 9 is a cross-sectional view of a sixth embodiment for a condenser of this application in an axial direction of a shell (i.e. C-C line direction in FIG. 2) to illustrate various components in the oil separation cavity 315. An external structure of the condenser according to the sixth embodiment is shown in FIG. 2, and a positional relationship between an oil separation cavity and a condensation cavity therein is shown in FIG. 3. The arrows in FIG. 9 indicate a flow path of a mixture of gaseous refrigerant and lubricating oil in the oil separation cavity 315.

Specifically, the structure of a condenser 930 is substantially the same as the structure of the condenser 730 shown in FIG. 7, and the condenser 930 differs from the condenser 730 in that specific settings of a first flow guide channel 945 and a second flow guide channel 946 in a height direction are different. As shown in FIG. 9, an outlet 945*b* of the first flow guide channel 945 of the condenser 930 and an outlet 946*b* of the second flow guide channel 946 are disposed oppositely, and staggered in the height direction by a distance such that the outlet 946*b* is below the outlet 945*b* in the height direction. Therefore, in the present embodiment, it is possible to prevent the mixture flowing out of one of the flow guide channels from penetrating into the other flow guide channel due to a high speed without providing the blocking member.

It will be appreciated by those skilled in the art that, in other embodiments, the first flow guide channel and the second flow guide channel may not be tubular, so long as the outlet of the first flow guide channel and the outlet of the second flow guide channel are staggered by a certain distance in other directions perpendicular to the length direction of the shell, thereby preventing the mixture flowing out of one of the flow guide channels from penetrating into the other flow guide channel due to a high speed.

Figure 10:
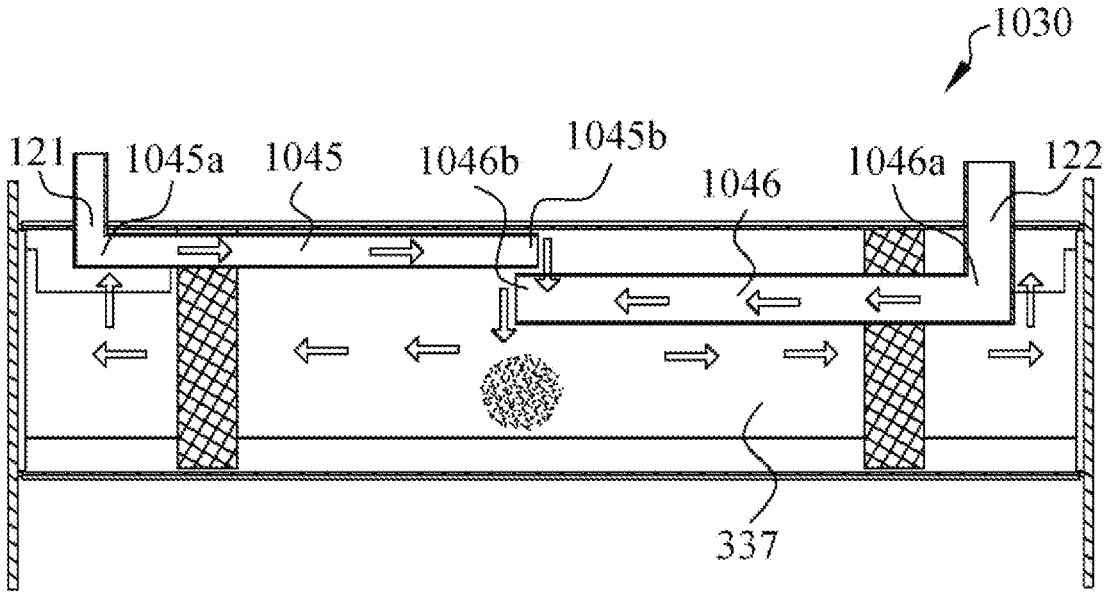
FIG. 10 is an axial cross-sectional view of a seventh embodiment for the condenser in FIG. 1.

FIG. 10 is a cross-sectional view of a seventh embodiment for a condenser of this application in an axial direction of a shell (i.e. C-C line direction in FIG. 2) to illustrate various components in the oil separation cavity 315. An external structure of the condenser according to the seventh embodiment is shown in FIG. 2, and a positional relationship between an oil separation cavity and a condensation cavity therein is shown in FIG. 3. The arrows in FIG. 10 indicate a flow path of a mixture of gaseous refrigerant and lubricating oil in the oil separation cavity 315.

Specifically, the structure of a condenser 1030 is substantially the same as the structure of the condenser 930 shown in FIG. 9, and the condenser 1030 differs from the condenser 930 in that an outlet 1045*b* of a first flow guide channel 1045 and an outlet 1046*b* of a second flow guide channel 1046 are disposed at different positions. As shown in FIG. 10, the first flow guide channel 1045 and the second flow guide channel 1046 of the condenser 1030 extend from both ends of the shell 201 toward the middle to cross each other respectively, i.e. the outlet 1045*b* of the first flow guide channel 1045 is located on the right side of the outlet 1046*b* of the second flow guide channel 1046. In other words, the outlet 1045*b* of the first flow guide channel 1045 is located between the outlet 1046*b* of the second flow guide channel 1046 and an inlet 1046*a* of the second flow guide channel 1046, while the outlet 1046*b* of the second flow guide channel 1046 is located between the outlet 1045*b* of the first flow guide channel 1045 and an inlet 1045*a* of the first flow guide channel 1045. At this moment, it is possible to prevent the mixture flowing out of one of the flow guide channels from penetrating into the other flow guide channel due to a high speed without providing the blocking member.

Figure 11:
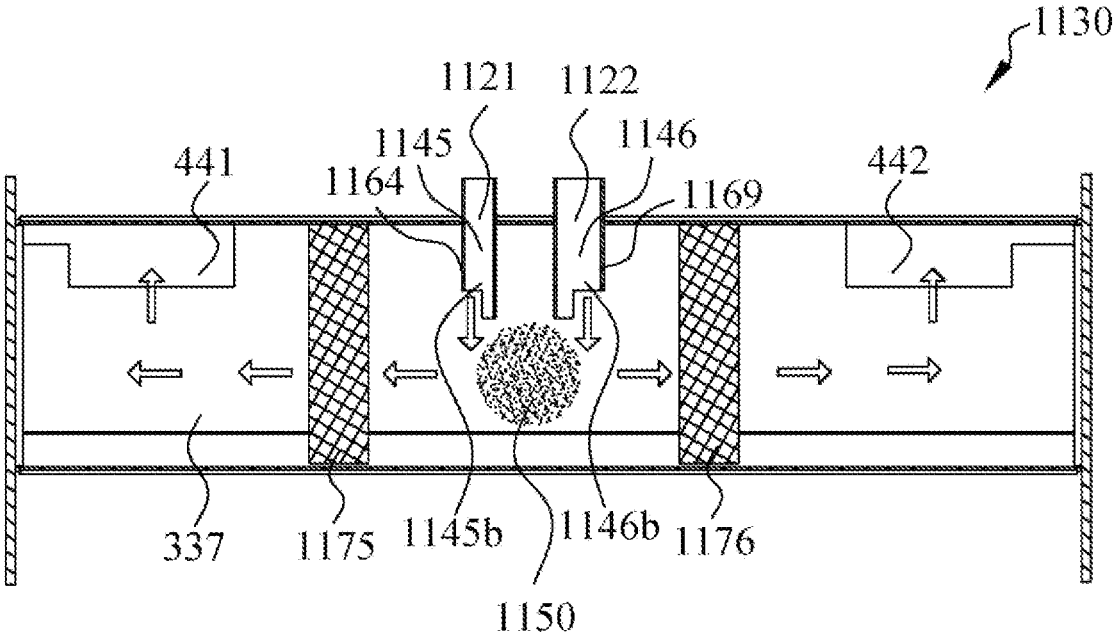
FIG. 11 is an axial cross-sectional view of an eighth embodiment for the condenser in FIG. 1.

FIG. 11 is a cross-sectional view of an eighth embodiment for a condenser of this application in an axial direction of a shell (i.e. C-C line direction in FIG. 2) to illustrate various components in the oil separation cavity 315. An external structure of the condenser according to the eighth embodiment is slightly different from that shown in FIG. 2, and the first refrigerant inlet 121 and the second refrigerant inlet 122 are close to the middle in the axial direction of the shell. A positional relationship between an oil separation cavity and a condensation cavity inside the condenser according to the eighth embodiment is shown in FIG. 3. The arrows in FIG. 11 indicate a flow path of a mixture of gaseous refrigerant and lubricating oil in the oil separation cavity 315.

As shown in FIG. 11, a first flow guide channel 1145 and a second flow guide channel 1146 in a condenser 1130 are formed by a straight flow guide tube 1164 and a straight flow guide tube 1169 respectively. The straight flow guide tube 1164 and the straight flow guide tube 1169 are disposed side by side in the middle of the shell 201. The straight flow guide tube 1164 extends out upward through the first refrigerant inlet 121 disposed on the shell 201 to be connected to the exhaust port 151 of the first compressor 108. The straight flow guide tube 1169 extends out upward through the second refrigerant inlet 122 disposed on the shell 201 to be connected to the exhaust port 152 of the second compressor 109. An outlet 1145*b* of the first flow guide channel 1145 is disposed at a lower end of the first flow guide channel 1145. An outlet 1146*b* of the second flow guide channel 1146 is disposed at a lower end of the second flow guide channel 1146. As one example, the outlet of the first flow guide channel 1145 and the outlet of the second flow guide channel 1146 are disposed back to back. Thus, the mixture flows from the first refrigerant inlet 1121 and the second refrigerant inlet 1122 into the first flow guide channel 1145 and the second flow guide channel 1146, respectively, and flows downward into the oil separation cavity 315 to be mixed at the mixing region 1150 below the respective outlets.

Similar to the embodiment shown in FIGS. 4A-4C, the condenser 1130 further includes a first filter screen 1175, a second filter screen 1176, a left communication port 441, and a right communication port 442. The left communication port 441 and the right communication port 442 are disposed at left and right ends of the oil separation baffle 337. The mixed mixture is uniformly divided into two portions. One portion flows through the first filter screen 1175 to separate lubricating oil. A gaseous refrigerant separated from the lubricating oil then flows into the condensation cavity from the left communication port 441. The other portion flows through the second filter screen 1176 to separate the lubricating oil. The gaseous refrigerant separated from the lubricating oil then flows into the condensation cavity from the right communication port 442.

Since the outlets of the first flow guide channel 1145 and the second flow guide channel 1146 are disposed back to back (not directly opposite), there is also no need to provide a blocking member.

Although flow guide channels with different structures are designed in each of the aforementioned embodiments, at least a portion of a mixture from a large-displacement compressor can be mixed and uniformly distributed with a mixture from a small-displacement compressor before filtering by controlling a flow path of the mixture, so that the size of the oil separation cavity does not need to be designed in accordance with the displacement of the large-displacement compressor, and the requirement of fully filtering and separating lubricating oil can be met. The condenser of this application may reduce the size requirements of the oil separation cavity and, in turn, the condenser.

Figure 12:
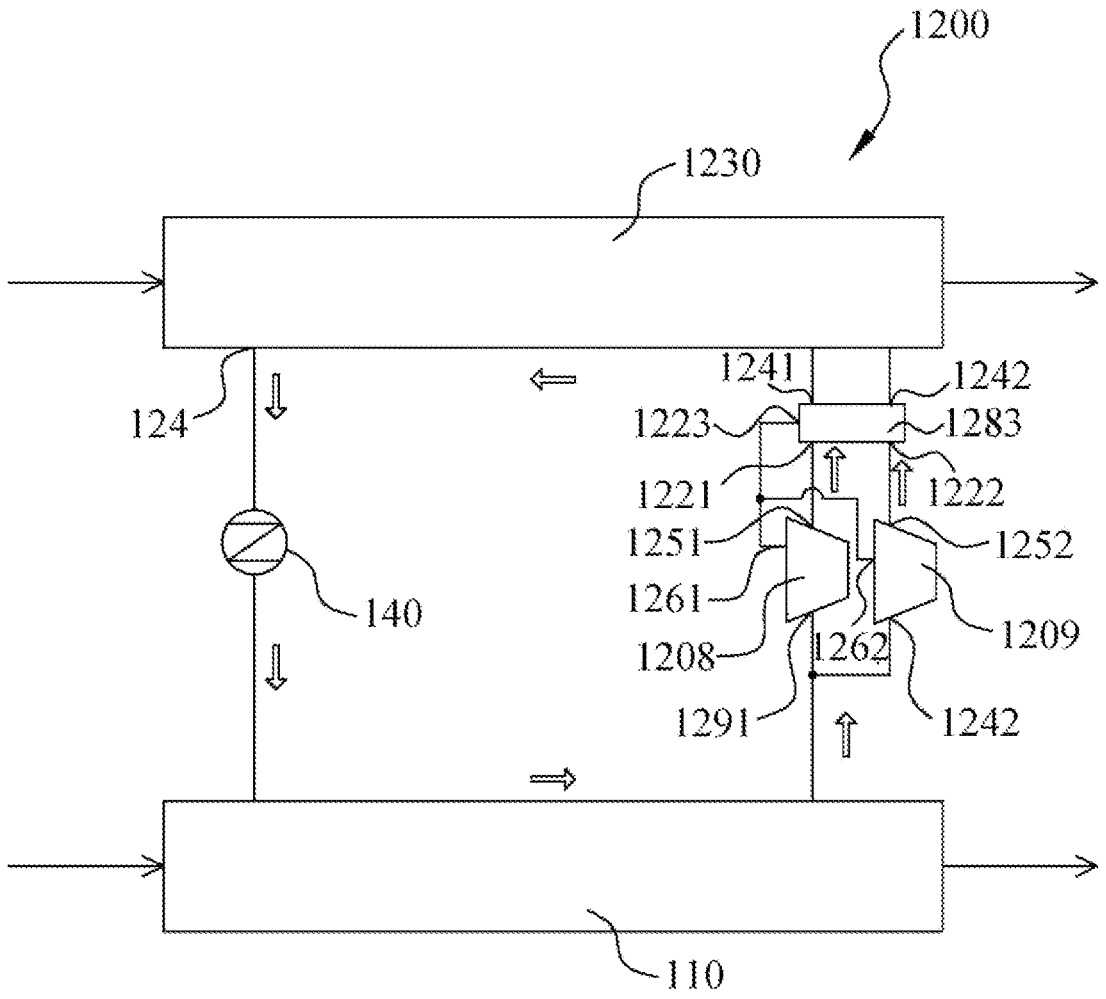
FIG. 12 is a structural block diagram of another embodiment for a refrigeration system of this application.

FIG. 12 is a structural block diagram of another embodiment for a refrigeration system of this application to illustrate a connection relationship between various components in the refrigeration system including an independent oil separation device. In this embodiment, the condenser does not have an oil separation function. As shown in FIG. 12, a refrigeration system 1200 includes a compressor unit, a condenser 1230, a throttle device 140, and an evaporator 110 sequentially connected in through a pipeline to form a refrigerant circulation circuit. An oil separation device 1283 is further disposed between the compressor unit and the condenser 1230. The compressor unit includes a first compressor 1208 and a second compressor 1209. In the present embodiment, the first compressor 1208 has a smaller displacement (i.e. refrigerant gas flow) than the second compressor 1209, and the first compressor 1208 and the second compressor 1209 are connected in parallel between the oil separation device 1283 and the evaporator 110.

Specifically, the first compressor 1208 is provided with a suction port 1291, an exhaust port 1251 and an oil return port 1261. The second compressor 1209 is provided with a suction port 1242, an exhaust port 1252 and an oil return port 1262. The oil separation device 1283 is provided with a first refrigerant inlet 1221, a second refrigerant inlet 1222, an oil outlet 1223, and at least one communication port (i.e. oil separation device refrigerant gas outlet). As one example, the at least one communication port includes two communication ports (i.e. oil separation device refrigerant gas outlets) 1241 and 1242. The suction port 1291 of the first compressor 1208 and the suction port 1242 of the second compressor 1209 are both connected to an outlet of the evaporator 110. The exhaust port 151 of the first compressor 108 is connected to the first refrigerant inlet 121 of the condenser 130. The oil return port 1261 of the first compressor 1208 is connected to the oil outlet 1223 of the oil separation device 1283. The exhaust port 1252 of the second compressor 1209 is connected to the second refrigerant inlet 1222 of the oil separation device 1283. The oil return port 1262 of the second compressor 1209 is also connected to the oil outlet 1223 of the oil separation device 1283. An inlet of the condenser 1230 is connected to the communication ports 1241 and 1242, and a refrigerant outlet 124 of the condenser 1230 is connected to the throttle device 140.

The refrigeration system 100 is filled with a refrigerant and a lubricating substance (e.g. lubricating oil). An operation process of the refrigeration system 1200 is briefly described below:

In the first compressor 1208 and the second compressor 1209, a low-temperature low-pressure gaseous refrigerant is compressed into a high-temperature high-pressure gaseous refrigerant. The high-temperature high-pressure gaseous refrigerant passes through the first refrigerant inlet 1221 and the second refrigerant inlet 1222 on the oil separation device 1283, respectively, first passes through the oil separation device 1283, and then flows into the condenser 1230 to be exothermically condensed into a high-pressure liquid refrigerant (possibly containing a portion of gaseous refrigerant). The high-pressure liquid refrigerant is discharged from the refrigerant outlet 124 of the condenser 1230, and flows through and is throttled by the throttle device 140 into a low-pressure liquid refrigerant. Subsequently, the low-pressure liquid refrigerant is endothermically evaporated in the evaporator 110 into a low-pressure gaseous refrigerant and then returned to the first compressor 1208 and the second compressor 1209. The operation is repeated to complete a continuous refrigeration cycle.

In the first compressor 1208 and the second compressor 1209, the lubricating oil is used for lubricating the first compressor 1208 and the second compressor 1209, and then the lubricating oil is discharged from the first compressor 1208 and the second compressor 1209 together with the gaseous refrigerant. The discharged mixture of high-pressure gaseous refrigerant and lubricating oil (hereinafter referred to as "mixture") enters the oil separation device 1283. In the oil separation cavity 1315 (not shown, see FIG. 13) of the oil separation device 1283, the high-pressure gaseous refrigerant is separated from the lubricating oil. The separated high-pressure gaseous refrigerant enters the condenser 1230 as described above, while the separated lubricating oil flows back to the first compressor 1208 and the second compressor 1209 through the oil outlet 1223 on the oil separation device 1283.

Figure 13:
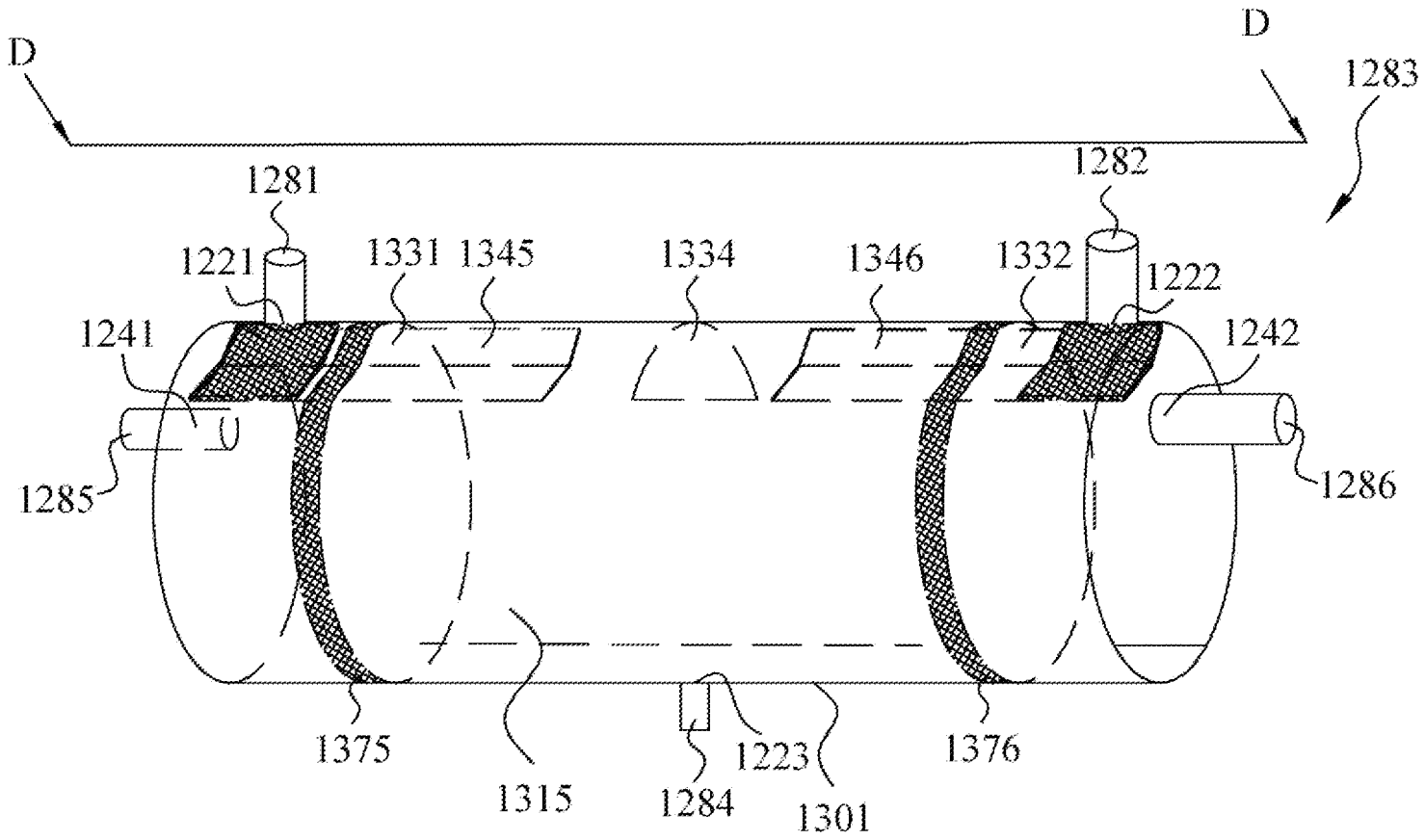
FIG. 13 is a structural stereogram of one embodiment for an oil separation device in FIG. 12.

FIG. 13 is a structural stereogram of some embodiments for the oil separation device 1283 shown according to FIG. 12. As shown in FIG. 13, the oil separation device 1283 includes a shell 1301, and the shell 1301 includes an oil separation cavity 1315 therein. The shell 1301 is provided with a first refrigerant inlet 1221, a second refrigerant inlet 1222, an oil outlet 1223, and communication ports 1241 and 1242. As a specific example, the first refrigerant inlet 1221 and the second refrigerant inlet 1222 are located at an upper portion of the shell 1301 and are disposed near left and right ends of the shell 1301, respectively. The oil outlet 1223 is disposed at a lower portion of the shell 1301. The communication ports 1241 and 1242 are disposed at the left and right ends of the shell 1301, respectively.

The oil separation device 1283 further includes a pipeline 1281, a pipeline 1282, a pipeline 1284, a pipeline 1285, and a pipeline 1286. The pipeline 1281 is communicated with the first refrigerant inlet 1221 such that the first refrigerant inlet 1221 is connected to the exhaust port 1251 of the first compressor 1208. The pipeline 1282 is communicated with the second refrigerant inlet 1222 such that the second refrigerant inlet 1222 is connected to the exhaust port 1252 of the second compressor 109. The pipeline 1284 is communicated with the oil outlet 1223 such that the oil outlet 1223 is connected to the oil return port 1261 and the oil return port 1262. The pipeline 1285 and the pipeline 1286 are communicated with the communication ports 1241 and 1242, respectively, so that the communication ports 1241 and 1242 are connected to the condenser 1230.

It is to be noted that the first refrigerant inlet 1221, the second refrigerant inlet 1222, the oil outlet 1223, and the communication ports 1241 and 1242 of the oil separation device may be arranged at different positions according to specific settings of different oil separation devices. For example, in an embodiment shown in FIG. 21, the first refrigerant inlet 1221 and the second refrigerant inlet 1222 are disposed in the middle of the shell 201. Also, the at least one communication port may not include two communication ports. For example, in the embodiment shown in FIG. 18, only one communication port may be included.

A first flow guide baffle 1331, a second flow guide baffle 1332, a blocking member 1334, a first filter screen 1375, and a second filter screen 1376 are further disposed inside the oil separation cavity 1315 of the oil separation device 1283. A first flow guide channel 1345 is formed by the first flow guide baffle 1331 and the shell 1301, and a second flow guide channel 1346 is formed by the second flow guide baffle 1332 and the shell 1301.

Figure 14:
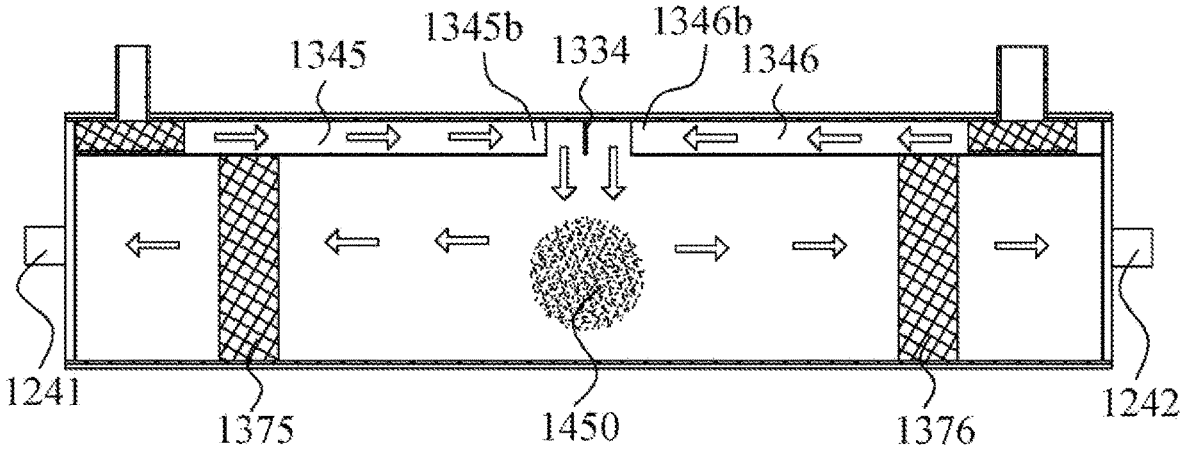
FIG. 14 is an axial cross-sectional view of the oil separation device in FIG. 13.

FIG. 14 is a cross-sectional view of the oil separation device 1283 in FIG. 13 along an axial direction of a shell (i.e. D-D line direction in FIG. 13) to illustrate a specific structure in the oil separation cavity 1315. As shown in FIG. 14, an internal structure of the oil separation cavity 1315 is substantially the same as the internal structure of the oil separation cavity 315 of the condenser 430 in FIGS. 4A-4C, except that the oil separation device 1283 does not include an oil separation baffle, and a communication port, which is originally disposed on the oil separation baffle, is disposed directly on the shell 1301. At this moment, the communication port is used for fluid communication with the condensation device in the condenser 1230, so that a gaseous refrigerant flowing out of the communication port can be condensed by the condensation device.

Specifically, a mixture (hereinafter referred to as "first mixture") of high-pressure gaseous refrigerant and lubricating oil discharged from the first compressor 1208 enters the oil separation cavity 1315 and then flows in a substantially horizontal direction along the first flow guide channel 1345 to an outlet 1345*b*. A mixture (hereinafter referred to as "second mixture") of high-pressure gaseous refrigerant and lubricating oil discharged from the second compressor 1209 enters the oil separation cavity 1315 and then flows in a substantially horizontal direction along the second flow guide channel 1346 to an outlet 1346*b*. The first mixture and the second mixture change the flow direction into downward flow after hitting against the blocking member 1334 from the left side and the right side respectively, are mixed approximately at a mixing region 1450, are averagely divided into two portions, are filtered by the first filter screen 1375 and the second filter screen 1376 respectively to separate lubricating oil, and then the lubricating oil flows into the condenser through the communication ports 1241 and 1242 for condensation.

Figure 15:
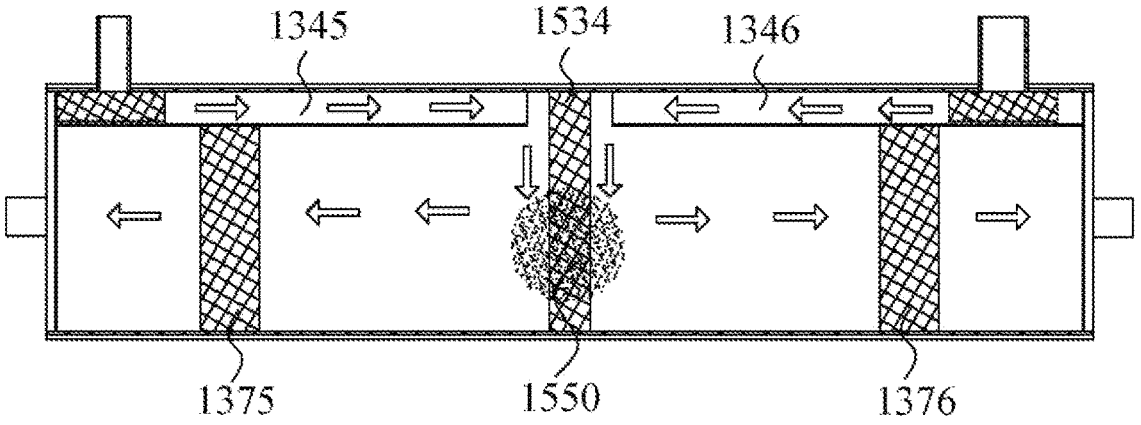
FIG. 15 is an axial cross-sectional view of a second embodiment for the oil separation device in FIG. 12.

FIG. 15 is a cross-sectional view of a second embodiment for an oil separation device of this application in an axial direction of a shell (i.e. in D-D line direction in FIG. 13). As shown in FIG. 15, an external structure of the oil separation device according to the second embodiment is the same as that of the embodiment shown in FIG. 13. An internal structure of an oil separation cavity of the oil separation device according to the second embodiment is substantially the same as the internal structure of the oil separation cavity of the condenser shown in FIG. 5, and is substantially the same as the embodiment shown in FIG. 14, except that: in the embodiment shown in FIG. 15, the blocking member is a filter screen 1534 rather than a blocking plate, and a mixing region 1550 of a gaseous refrigerant is generally in the vicinity of the filter screen 1534.

Figure 16:
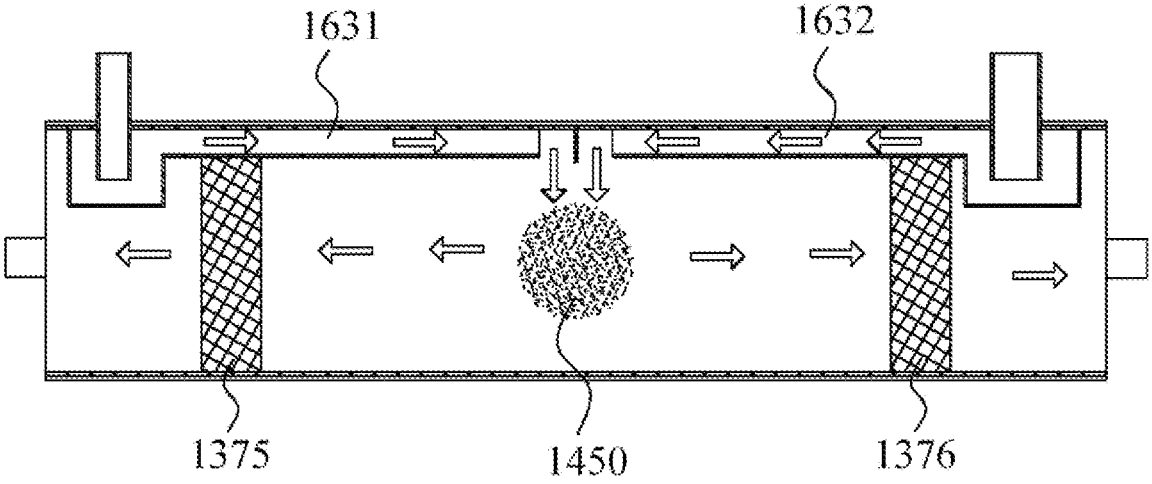
FIG. 16 is an axial cross-sectional view of a third embodiment for the oil separation device in FIG. 12.

FIG. 16 is a cross-sectional view of a third embodiment for an oil separation device of this application in an axial direction of a shell (i.e. in D-D line direction in FIG. 13). As shown in FIG. 16, an external structure of the oil separation device according to the third embodiment is the same as that of the embodiment shown in FIG. 13. An internal structure of an oil separation cavity of the oil separation device according to the third embodiment is substantially the same as the internal structure of the oil separation cavity of the condenser shown in FIG. 6, and is substantially the same as the embodiment shown in FIG. 14, except that: a left end of a first flow guide baffle 1631 and a right end of the second flow guide baffle 1632 are designed in the shape of a box with an open top.

Figure 17:
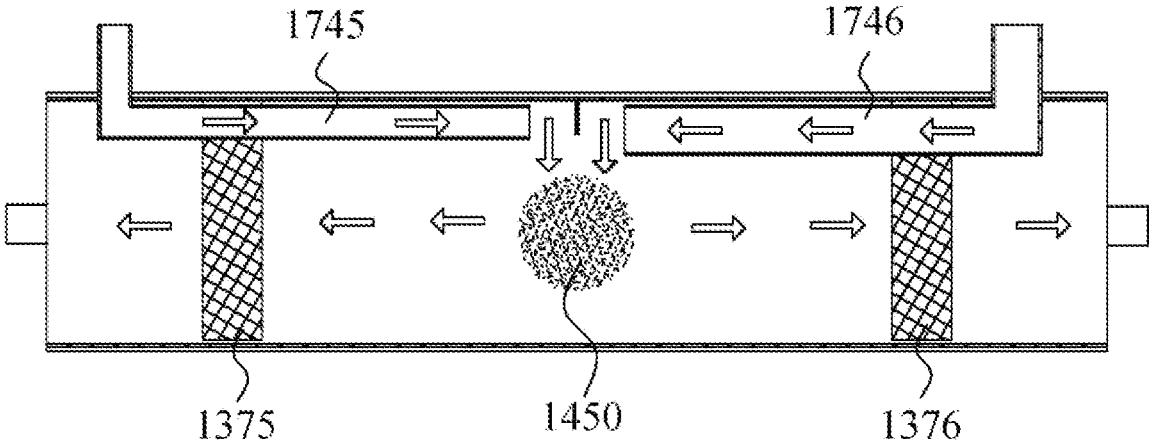
FIG. 17 is an axial cross-sectional view of a fourth embodiment for the oil separation device in FIG. 12.

FIG. 17 is a cross-sectional view of a fourth embodiment for an oil separation device of this application in an axial direction of a shell (i.e. in D-D line direction in FIG. 13). As shown in FIG. 17, an external structure of the oil separation device according to the fourth embodiment is the same as that of the embodiment shown in FIG. 13. An internal structure of an oil separation cavity of the oil separation device according to the fourth embodiment is substantially the same as the internal structure of the oil separation cavity of the condenser shown in FIG. 7, and is substantially the same as the embodiment shown in FIG. 14, except that: a first flow guide channel 1745 and a second flow guide channel 1746 are formed by flow guide tubes respectively.

Figure 18:
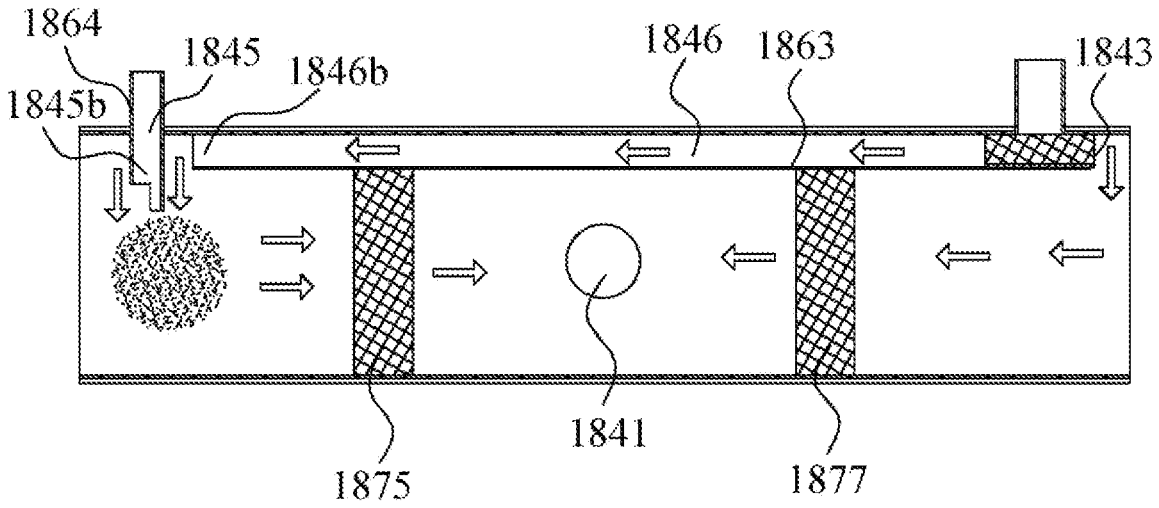
FIG. 18 is an axial cross-sectional view of a fifth embodiment for the oil separation device in FIG. 12.

FIG. 18 is a cross-sectional view of a fifth embodiment for an oil separation device of this application in an axial direction of a shell (i.e. in D-D line direction in FIG. 13). As shown in FIG. 18, an external structure of the oil separation device according to the fifth embodiment is slightly different from the embodiment shown in FIG. 13 in that only one communication port 1841 is included and the communication port 1841 is disposed on the rear side of the middle of the shell of the oil separation device. An internal structure of an oil separation cavity of the oil separation device according to the fifth embodiment is substantially the same as the internal structure of the oil separation cavity of the condenser shown in FIG. 8, and is substantially the same as the embodiment shown in FIG. 14, except that: a first flow guide channel 1845 is formed by a straight flow guide tube 1864, and an outlet 1845*b* of the first flow guide channel 1845 is disposed at a lower end of the first flow guide channel 1845. The second flow guide channel 1846 is formed by a flow guide baffle 1863 and a shell 1301, and the second flow guide channel 1846 has an outlet 1846*b* at a left end thereof and an additional outlet 1843 at a right end thereof. The outlet 1846*b* of the second flow guide channel 1846 is close to the outlet 1845*b* of the first flow guide channel 1845, and the additional outlet 1843 of the second flow guide channel 1846 is away from the outlet 1845*b* of the first flow guide channel 1845. In the embodiment shown in FIG. 18, a first filter screen 1875 is disposed between the outlet 1846*b* of the second flow guide channel 1846 and the communication port 1841, and an additional filter screen 1877 is disposed between the additional outlet 1843 of the second flow guide channel 1846 and the communication port 1841.

Figure 19:
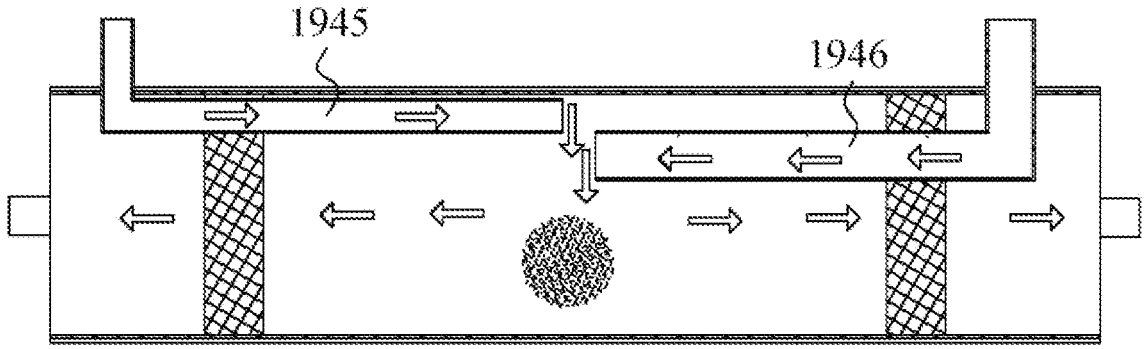
FIG. 19 is an axial cross-sectional view of a sixth embodiment for the oil separation device in FIG. 12.

FIG. 19 is a cross-sectional view of a sixth embodiment for an oil separation device of this application in an axial direction of a shell (i.e. in D-D line direction in FIG. 13). As shown in FIG. 19, an external structure of the oil separation device according to the sixth embodiment is the same as that of the embodiment shown in FIG. 13. An internal structure of an oil separation cavity of the oil separation device according to the sixth embodiment is substantially the same as the internal structure of the oil separation cavity of the condenser shown in FIG. 9, and is substantially the same as the embodiment shown in FIG. 14, except that: an outlet of a first flow guide channel 1945 and an outlet of a second flow guide channel 1946 are disposed oppositely, and staggered by a distance in a height direction.

Figure 20:
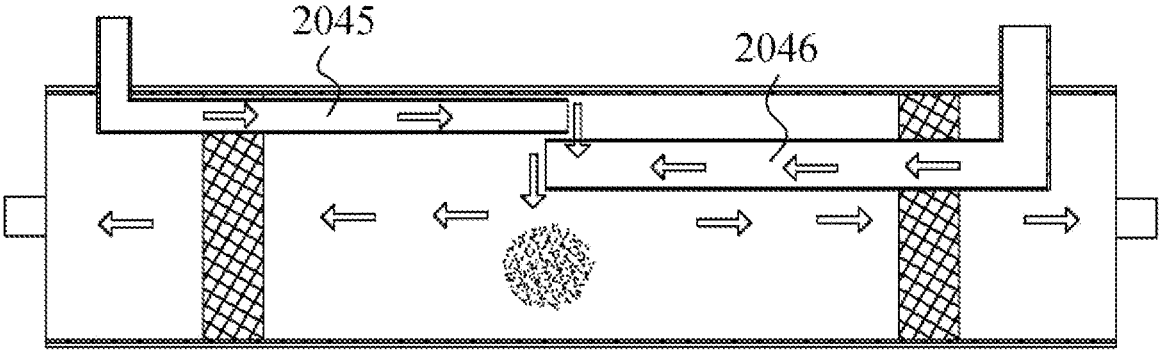
FIG. 20 is an axial cross-sectional view of a seventh embodiment for the oil separation device in FIG. 12.

FIG. 20 is a cross-sectional view of a seventh embodiment for an oil separation device of this application in an axial direction of a shell (i.e. in D-D line direction in FIG. 13). As shown in FIG. 20, an external structure of the oil separation device according to the seventh embodiment is the same as that of the embodiment shown in FIG. 13. An internal structure of an oil separation cavity of the oil separation device according to the seventh embodiment is substantially the same as the internal structure of the oil separation cavity of the condenser shown in FIG. 10, and is substantially the same as the embodiment shown in FIG. 14, except that: a first flow guide channel 2045 and a second flow guide channel 2046 extend from both ends of the shell of the oil separation device toward the middle to cross each other respectively.

Figure 21:
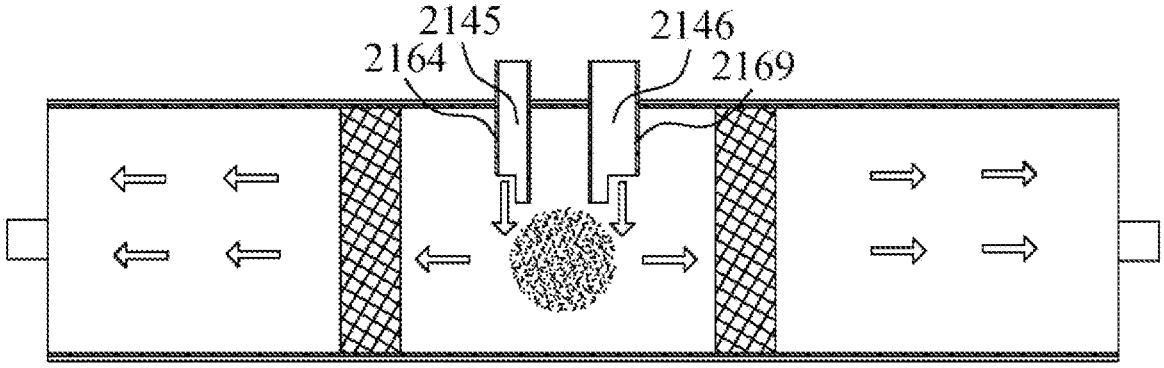
FIG. 21 is an axial cross-sectional view of an eighth embodiment for the oil separation device in FIG. 12.

FIG. 21 is a cross-sectional view of an eighth embodiment for an oil separation device of this application in an axial direction of a shell (i.e. in D-D line direction in FIG. 13). As shown in FIG. 21, an external structure of the oil separation device according to the eighth embodiment is slightly different from that of the embodiment shown in FIG. 13, and a first refrigerant inlet and a second refrigerant inlet are close to the middle in the axial direction of the shell. An internal structure of an oil separation cavity of the oil separation device according to the eighth embodiment is substantially the same as the internal structure of the oil separation cavity of the condenser shown in FIG. 11, and is substantially the same as the embodiment shown in FIG. 14, except that: a first flow guide channel 2145 and a second flow guide channel 2146 are vertical channels formed by a straight flow guide tube 2164 and a straight flow guide tube 2169 respectively, which extend longitudinally side by side from the middle of the shell of the oil separation device into the oil separation cavity 1315.

Similar to the foregoing condenser, in various embodiments of the oil separation device, when the displacement of the first compressor 1208 is smaller than the displacement of the second compressor 1209, the oil separation device 1283 enables a mixture of gaseous refrigerant and lubricating oil discharged from the first compressor 1208 and the second compressor 1209 to be mixed in the oil separation cavity 1315 and then divided into two uniform parts for filtration. Therefore, the requirement of fully filtering and separating a gaseous refrigerant and lubricating oil can be met without the need for designing the size of the oil separation cavity 1315 of the oil separation device 1283 in accordance with the displacement of a large-displacement compressor (i.e. second compressor 1209). The size of the oil separation cavity 1315 can be small, so that the overall size of the oil separation device 1283 is small.

It can be seen therefrom that, particularly for a refrigeration system including two compressors with unequal displacement, the condenser of this application may be provided in a smaller size compared to existing condensers with built-in oil separation components. Moreover, the oil separation device of this application may also be provided in a smaller size compared to existing oil separation devices.

Although this application is described with reference to specific implementations shown in the drawings, it is to be understood that many variations of the condenser and the oil separation device of this application are possible without departing from the spirit, scope and background of the teachings of this application. A person of ordinary skill in the art is further aware that there are different ways to change the structural details of the embodiments disclosed herein, which all fall within the spirit and scope of this application and the claims.

What is claimed is:

1. An oil separation device, comprising:

a shell comprising an oil separation cavity inside the shell;

a first refrigerant inlet and a second refrigerant inlet disposed on the shell;

two communication ports for fluid communication with a condensation device, wherein the two communication ports are respectively disposed at two opposite ends in a length direction of the shell;

a first flow guide channel disposed in the oil separation cavity, the first flow guide channel having a first inlet and a first outlet, the first inlet of the first flow guide channel being in fluid communication with the first refrigerant inlet so as to guide at least a first portion of refrigerant gas entering the first refrigerant inlet from the first inlet of the first flow guide channel to the first outlet of the first flow guide channel; and a second flow guide channel disposed in the oil separation cavity, the second flow guide channel having a second inlet and a second outlet, the second inlet of the second flow guide channel being in fluid communication with the second refrigerant inlet so as to guide at least a second portion of refrigerant gas entering the second refrigerant inlet from the second inlet of the second flow guide channel to the second outlet of the second flow guide channel, wherein the first flow guide channel is configured to direct the first portion of refrigerant gas through the first outlet in a first axial direction toward the second outlet, and the second flow guide channel is configured to direct the second portion of refrigerant gas through the second outlet in a second axial direction, opposite the first axial direction, toward the first outlet to enable mixing of the first portion of refrigerant gas flowing out of the first outlet of the first flow guide channel with the second portion of refrigerant gas flowing out of the second outlet of the second flow guide channel.

2. The oil separation device of claim 1, wherein the first outlet of the first flow guide channel and the second outlet of the second flow guide channel each face a middle of the shell relative to the length direction of the shell.

3. The oil separation device of claim 2, further comprising:

at least one filter screen disposed in the oil separation cavity transverse to the length direction of the shell, wherein the at least one filter screen is disposed between the two communication ports, so that mixed refrigerant gas formed via the first portion of refrigerant gas received from the first outlet and the second portion of refrigerant gas received from the second outlet is directed through the at least one filter screen to at least one communication port of the two communication ports.

4. The oil separation device of claim 3, wherein:

the at least one filter screen comprises a first filter screen and a second filter screen, wherein the first filter screen is disposed between the first outlet of the first flow guide channel and a first communication port of the two communication ports, and the second filter screen is disposed between the second outlet of the second flow guide channel and a second communication port of the two communication ports.

5. The oil separation device of claim 1, wherein:

the first flow guide channel and the second flow guide channel extend toward a middle of the shell along the length direction of the shell from the two opposite ends in the length direction of the shell, wherein the first outlet of the first flow guide channel and the second outlet of the second flow guide channel are spaced apart by a first distance in the length direction of the shell or staggered by a second distance in a direction perpendicular to the length direction of the shell.

6. The oil separation device of claim 5, further comprising:

a blocking member disposed between the first outlet of the first flow guide channel and the second outlet of the second flow guide channel, wherein a position and a size of the blocking member are configured such that the blocking member is configured to at least partially overlap with the first outlet of the first flow guide channel and the second outlet of the second flow guide channel in the length direction of the shell.

7. The oil separation device of claim 6, wherein the blocking member is a filter screen.

8. The oil separation device of claim 5, wherein the first flow guide channel is formed by a first flow guide baffle and the shell, and the second flow guide channel is formed by a second flow guide baffle and the shell.

9. A refrigeration system, comprising:

a compressor unit;

an oil separation device according to claim 1;

a condenser;

a throttle device; and an evaporator, wherein the compressor unit, the oil separation device, the condenser, the throttle device, and the evaporator are sequentially connected to form a refrigerant circulation loop, wherein the compressor unit comprises: a first compressor and a second compressor connected in parallel between the oil separation device and the evaporator, wherein a first suction port of the first compressor and a second suction port of the second compressor are connected to the evaporator, and wherein a first exhaust port of the first compressor is connected to the first refrigerant inlet of the oil separation device, and a second exhaust port of the second compressor is connected to the second refrigerant inlet of the oil separation device.

10. The refrigeration system of claim 9, wherein a first displacement of the first compressor is smaller than a second displacement of the second compressor.

11. A condenser, comprising:

a shell having an accommodating cavity inside the shell;

an oil separation baffle disposed in the shell and extending along a length direction of the shell, the oil separation baffle partitioning the accommodating cavity into an oil separation cavity and a condensation cavity, the oil separation baffle comprising at least one communication port communicating the oil separation cavity and the condensation cavity, wherein the at least one communication port comprises two communication ports which are respectively disposed at two opposite ends in the length direction of the shell;

a first refrigerant inlet and a second refrigerant inlet disposed on the shell;

a first flow guide channel disposed in the oil separation cavity, the first flow guide channel having a first inlet and a first outlet, the first inlet of the first flow guide channel being in fluid communication with the first refrigerant inlet so as to guide at least a first portion of refrigerant gas entering the first refrigerant inlet from the first inlet of the first flow guide channel to the first outlet of the first flow guide channel; and a second flow guide channel disposed in the oil separation cavity, the second flow guide channel having a second inlet and a second outlet, the second inlet of the second flow guide channel being in fluid communication with the second refrigerant inlet so as to guide at least a second portion of refrigerant gas entering the second refrigerant inlet from the second inlet of the second flow guide channel to the second outlet of the second flow guide channel, wherein the first flow guide channel is configured to direct the first portion of refrigerant gas through the first outlet in a first axial direction toward the second outlet, and the second flow guide channel is configured to direct the second portion of refrigerant gas through the second outlet in a second axial direction, opposite the first axial direction, toward the first outlet to enable mixing of the first portion of refrigerant gas flowing out of the first outlet of the first flow guide channel with the second portion of refrigerant gas flowing out of the second outlet of the second flow guide channel.

12. The condenser of claim 11, further comprising:

at least one filter screen disposed in the oil separation cavity perpendicular to the length direction of the shell, wherein the at least one filter screen is disposed between the at least one-two communication ports, so that mixed refrigerant gas formed via the first portion of refrigerant gas received from the first outlet and the second portion of refrigerant gas received from the second outlet is directed through the at least one filter screen to at least one of the two communication ports.

13. The condenser of claim 12, wherein:

the at least one filter screen comprises a first filter screen and a second filter screen, wherein the first filter screen is disposed between the first outlet of the first flow guide channel and a first communication port of the two communication ports, and the second filter screen is disposed between the second outlet of the second flow guide channel and a second communication port of the two communication ports.

14. The condenser of claim 11, wherein:

the first flow guide channel and the second flow guide channel extend toward a middle of the shell along the length direction of the shell from the two opposite ends in the length direction of the shell, wherein the first outlet of the first flow guide channel and the second outlet of the second flow guide channel are spaced apart by a first distance in the length direction of the shell or staggered by a second distance in a direction perpendicular to the length direction of the shell.

15. The condenser of claim 14, further comprising:

a blocking member disposed between the first outlet of the first flow guide channel and the second outlet of the second flow guide channel, wherein a position and a size of the blocking member are configured such that the blocking member at least partially overlaps with the first outlet of the first flow guide channel and the second outlet of the second flow guide channel in the length direction of the shell.

16. The condenser of claim 15, wherein the blocking member is a filter screen.

17. The condenser of claim 14, wherein the first flow guide channel is formed by a first flow guide baffle and the shell, and the second flow guide channel is formed by a second flow guide baffle and the shell.

18. A refrigeration system, comprising:

a compressor unit;

a condenser according to claim 11;

a throttle device; and an evaporator, wherein the compressor unit, the condenser, the throttle device, and the evaporator are sequentially connected to form a refrigerant circulation loop, wherein the compressor unit comprises: a first compressor and a second compressor connected in parallel between the condenser and the evaporator, wherein a first suction port of the first compressor and a second suction port of the second compressor are connected to the evaporator, and wherein a first exhaust port of the first compressor is connected to the first refrigerant inlet of the condenser, and a second exhaust port of the second compressor is connected to the second refrigerant inlet of the condenser.

19. The refrigeration system of claim 18, wherein a first displacement of the first compressor is smaller than a second displacement of the second compressor.

* * * * *